US006337705B1

(12) United States Patent
Tanaka et al.

(10) Patent No.: US 6,337,705 B1
(45) Date of Patent: Jan. 8, 2002

(54) IMAGE FORMING APPARATUS HAVING A COMPACT SIZE

(75) Inventors: Shigeru Tanaka; Atsuhiro Doi; Toshiya Kojima; Hiroshi Inoue; Hiroyuki Kohda, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/487,291

(22) Filed: Jan. 19, 2000

(30) Foreign Application Priority Data

Feb. 2, 1999 (JP) ..... 11-025541

(51) Int. Cl.[7] ..... B41J 2/325
(52) U.S. Cl. ..... 347/213; 347/217
(58) Field of Search ..... 347/228, 217, 347/215, 213; 399/7, 110, 154, 239, 385, 297, 302; 396/406, 604; 242/532.5, 532.4; 358/304, 502, 503, 505

(56) References Cited

U.S. PATENT DOCUMENTS 4,531,684 A * 7/1985 Mills ..... 242/532.5
5,038,208 A * 8/1991 Ichikawa et al. ..... 358/502
5,722,001 A * 2/1998 Nishio ..... 399/7
5,768,675 A * 6/1998 Estabrooks ..... 399/385
5,918,083 A * 6/1999 Aoki et al. ..... 396/406
6,010,254 A * 1/2000 Sanada ..... 396/604

FOREIGN PATENT DOCUMENTS

JP 1-274145 A * 11/1989 ..... G03D/9/00

* cited by examiner

*Primary Examiner*—Hai C. Pham
(74) *Attorney, Agent, or Firm*—Sughrue Mion, PLLC

(57) ABSTRACT

An image forming apparatus includes a heating drum image forming material supply device that feeds the image forming material in the form of a roll and winds the image forming material to the heating drum, a photosensitive material supply device that feeds the photosensitive material in the form of a roll and conveys the photosensitive material to an exposure section, and a laminating section which laminates the photosensitive film and image forming film onto the heating drum, and a take up device for the used photosensitive material.

24 Claims, 24 Drawing Sheets

IMAGE FORMING APPARATUS HAVING A COMPACT SIZE

BACKGROUND OF THE INVENTION

1. Field of the Invention

The present invention relates to an image forming apparatus that thermally transfers an image that has been formed by exposing a photosensitive material, from the photosensitive material to an image-receiving material.

2. Description of the Related Art

A thermal transfer-type image forming apparatus transfers an image on a photosensitive material, which image was formed through imagewise exposure, to an image-receiving material. This type of image forming apparatus is ordinarily structured such that the photosensitive material is pulled out a predetermined length from a magazine, cut into the form of a sheet, and then sent to an exposure section.

After applying water to the photosensitive material that has been exposed at the exposure section, the photosensitive material is laminated with the image-receiving material and wound at a heating drum to be pressed against the heating drum for a predetermined period of time with an endless belt, thereby thermally transferring an image from the photosensitive material to the image-receiving material.

However, with such a structure, there is the necessity of making the diameter of the heating drum large in accordance with the size of the image to be transferred, and in conjunction, the length of the endless belt must be long. Therefore, the apparatus cannot be made compact.

Further, with such a structure, after the image has been transferred, disposing of the sheet-form photosensitive material in a bundled state is difficult.

SUMMARY OF THE INVENTION

The present invention was achieved in light of the above-described circumstances, and an object thereof is to make processing of used photosensitive material easy and to allow the size of an image forming apparatus to be reduced.

In the present invention, a photosensitive material supplying device pulls out a photosensitive material, which is in the form of a roll, and feeds it to an exposure section. The photosensitive material is exposed at the exposure section. Thereafter, a solvent is applied to the photosensitive material by an application device, and the photosensitive material is conveyed to a heating drum.

An image-receiving material supplying device pulls out an image-receiving material, which is in the form of a roll, cuts it to a desired size, and winds it at a heating drum. Simultaneously, at the heating drum, a laminating device laminates the image-receiving material and the photosensitive material, to which a solvent has been applied.

The heating drum, at which the photosensitive material and the image-receiving material have been wound, is rotated without being stopped, and while the photosensitive material and the image-receiving material are conveyed, an image on the photosensitive material is thermally transferred to the image-receiving material. Accordingly, the time taken for the image-receiving material, which has had the image thermally transferred thereto, to be discharged from the image forming apparatus is reduced.

Increasing the radius of the heating drum in accordance with the size of the image to be thermally transferred is not necessary as it is in conventional image forming apparatuses. An endless belt is also not necessary. Accordingly, the apparatus can be made compact.

Further, since the photosensitive material is conveyed from the photosensitive material-supplying device to a take-up device without being cut, the photosensitive material itself functions as an endless belt that applies a fixed pressure.

Since the photosensitive material that has been laminated with the image-receiving material is taken up by the take-up device without being cut into sheet-forms, processing of the used photosensitive material is made easy.

In the present invention, the laminating device preferably comprises: laminating rollers that rotate around the heating drum in a state where the photosensitive material and the image-receiving material are interposed between the laminating rollers and the heating drum; and a stripping device that strips a trailing-end side of the photosensitive material off from the heating drum, in conjunction with rotation of the laminating roller.

Taking as an example a case where image processing is carried out for a single sheet, the image-receiving material is conveyed to the heating drum after being cut into a sheet-form, which does not cause problems. The photosensitive material, however, continuously extends until the photosensitive material supplying device, since it is taken up by the take-up device.

When the photosensitive material is conveyed without being cut, after the image is transferred to the image-receiving material, regions of the photosensitive material that have not been exposed imagewise may contact the heating drum as the heating drum rotates. These regions of the photosensitive material can not be used for the subsequent image processing.

Accordingly, in a preferred embodiment of the present invention a structure has been adopted wherein the laminating rollers rotate about the heating drum with the photosensitive material and the image-receiving material interposed between the heating drum and the laminating rollers. The stripping device strips the trailing-end side of the photosensitive material off from the heating drum, in conjunction with movement of the laminating roller.

Namely, while maintaining a state in which the trailing end portion of the sheet-form image-receiving material and the photosensitive material are laminated together with the laminating rollers, the stripping device strips away from the heating drum the side of the photosensitive material towards the photosensitive material supplying device. Accordingly, the photosensitive material that has not yet been exposed does not contact the heating drum, and can be used in the next image formation processing.

In the present invention, a swinging device preferably supports an application unit provided with an application portion for applying a solvent, such that the application unit can be swung. A driving device rotates the application unit while causing the application portion to contact the photosensitive material at an angle such that the entire surface of the application portion is gradually brought into contact with the photosensitive material. Air is removed from between the surface of the photosensitive material and the application portion, thereby preventing uneven application.

According to another aspect of the present invention, the take-up device comprises: a core; a holding member swingably attached to the core, for holding an end portion of the photosensitive material against the core; an engaging pawl protruding from the core for penetrating the photosensitive material and passing therethrough; a flange provided at two ends of the core, at least one of the flanges being detachable; and a releasing device for collapsing the engaging pawl when the photosensitive material has been wound around the core, and is to be pulled therefrom in an axial direction of the core.

According to this structure, the holding member is collapsed toward the core, and an end portion of the photosensitive material is thereby held down by the holding member. The engaging pawl that is provided at the core so as to protrude therefrom is made to pass through the photosensitive material. Accordingly, the photosensitive material does not become removed from between the core and the holding member.

The flange that is provided at each of the two ends of the core prevents the photosensitive material from shifting sideways when the photosensitive material that has been used is taken up. At least one of the flanges is attached such that detachment is possible. After all of the used photosensitive material is taken up, the flange can be removed, and the photosensitive material, which is in the form of a roll, can be pulled out in the shaft direction of the core.

At this time, the releasing device functions to collapse the engaging pawl, which has been passed through the photosensitive material. Accordingly, the photosensitive material, which is in the form of a roll, can be removed without using much force.

DESCRIPTION OF THE PREFERRED EMBODIMENTS

Figure 1:
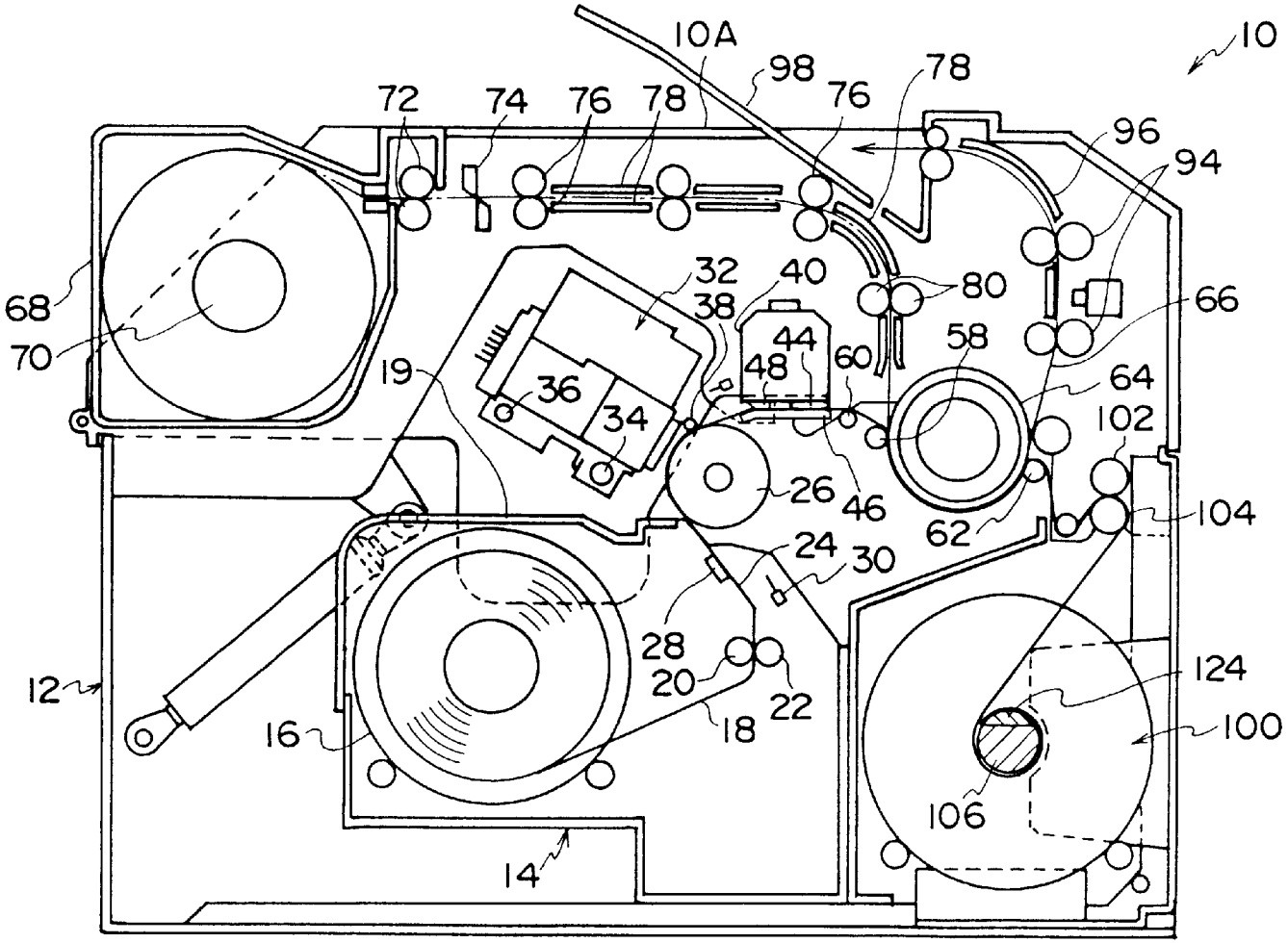
FIG. 1 is a side view showing an entire structure of an image forming apparatus according to an embodiment of the present invention, and an operating procedure thereof.

An image forming apparatus 10 according to the present embodiment is shown in FIG. 1.

A supply reel 16 around which a photosensitive material 18 is wound is set in a photosensitive material magazine 14 disposed at a lower side of a housing 12 of the image forming apparatus 10.

A top cover 19 of the photosensitive material magazine 14 is structured so that opening and closing thereof is possible. A nip roller 20 is attached to a portion at the free end of the top cover 19. When the top cover 19 is closed, the nip roller 20, together with a nip roller 22 attached to the main body of the photosensitive material magazine 14, nips the photosensitive material 18, and conveys the photosensitive material 18 to a platen roll 26 (to be described later) via a guide plate 24.

Further, in a vicinity of a pull out opening of the guide plate 24, a light-shielding member 28 is provided, to prevent the photosensitive material 18 from fogging. Further, between the nip rollers 20, 22 and the light-shielding member 28, a sensor 30 is disposed, which detects the presence or absence of a buffer B2 and measures the timing at which the photosensitive material 18 is conveyed out. The speed at which the photosensitive material 18 is conveyed does not vary due to forming the buffer.

After the photosensitive material 18 is conveyed past the guide plate 24, the photosensitive material 18 is wound at the platen roll 26, which rotates, and imagewise exposure is carried out with a scanning head 32.

Three LED chips of R (red), G (green), B (blue) (these may be light sources such as an LED or the like), which are lit in accordance with signals from a control section in which image signals are recorded, are disposed on the scanning head 32. Light from the LED chips is condensed with a condenser lens structured by a plurality of lenses and an aperture stop, and is focused on the photosensitive material 18 to form an image. By winding the photosensitive material 18 at the platen roll 26 and exposing the photosensitive material 18 in this way, creases are prevented from forming on the photosensitive material 18 in the transverse direction thereof, and planarity of the exposure surface can be ensured.

Driving of the scanning head 32 is synchronized with step-driving (driving the platen roll 26 and conveying rollers) of the photosensitive material 18. Namely, after the photosensitive material 18 undergoes step movement and is then brought to a standstill, the scanning head 32 moves along shafts 34, 36 in the transverse direction of the photosensitive material 18 (main scanning direction). After the photosensitive material 18 undergoes further step movement and is then brought to a standstill, main scanning in the reverse direction is carried out.

Figure 10:
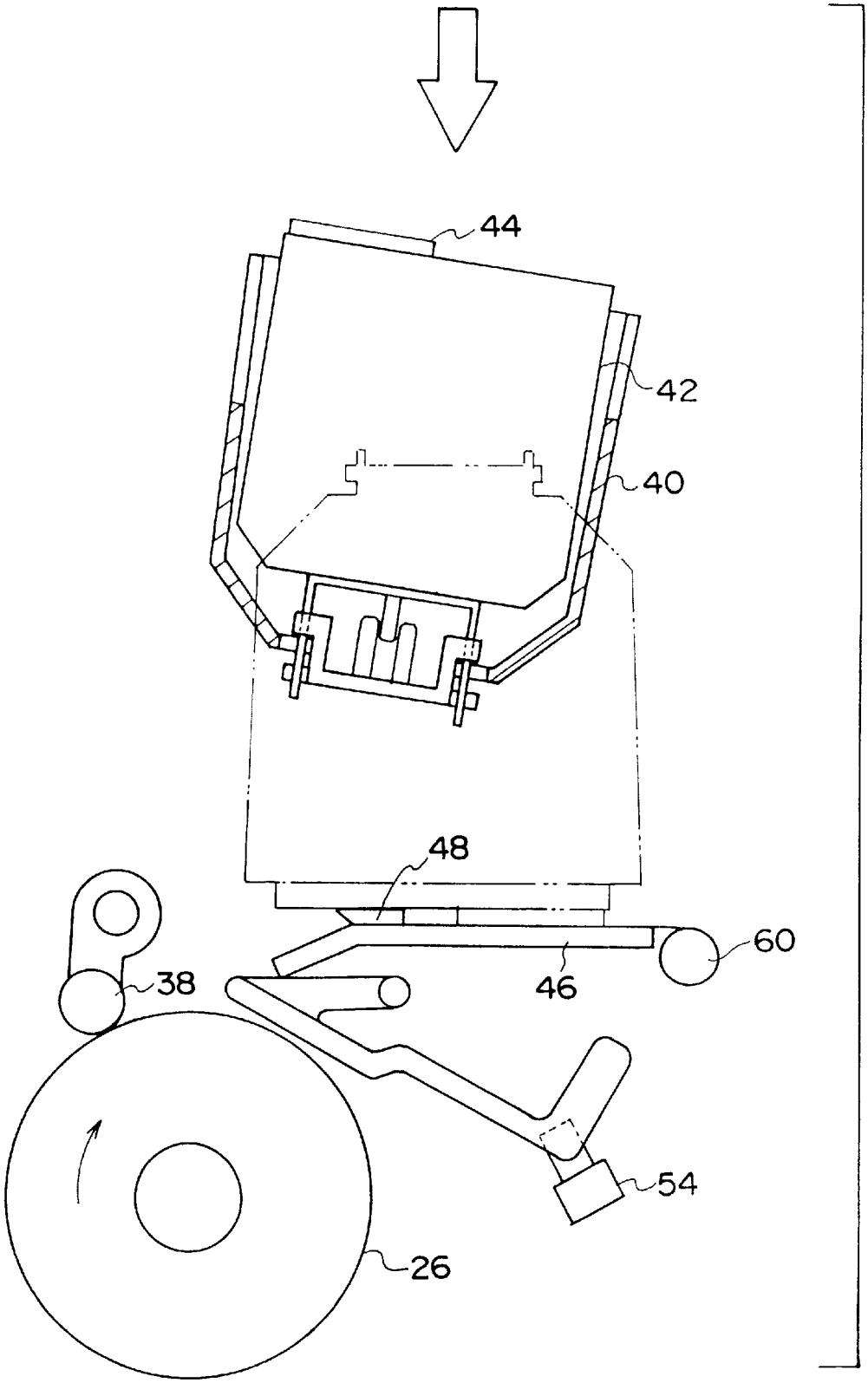
FIG. 10 is a side view showing a water application section of the image forming apparatus according to the present embodiment, and movement thereof.

Next, the photosensitive material 18, which has been exposed to form an image, is conveyed out to a water application section by a nip roller 38. At this water application section, a casing 40, which is supported so as to be swingable, is disposed. This casing 40, as illustrated in FIG. 10, is structured so as to be able to rise and rotate 180° C., and an application unit 42 can be easily disconnected from an aperture portion thereof.

A sponge 44 is attached at an application surface of the application unit 42. The sponge 44 squeezes out a fixed amount of water, regardless of the amount of water in a water tank (not illustrated). Accordingly, water droplets do not fall upon the photosensitive material 18, and excess water is not applied to the photosensitive material 18.

Figure 11:
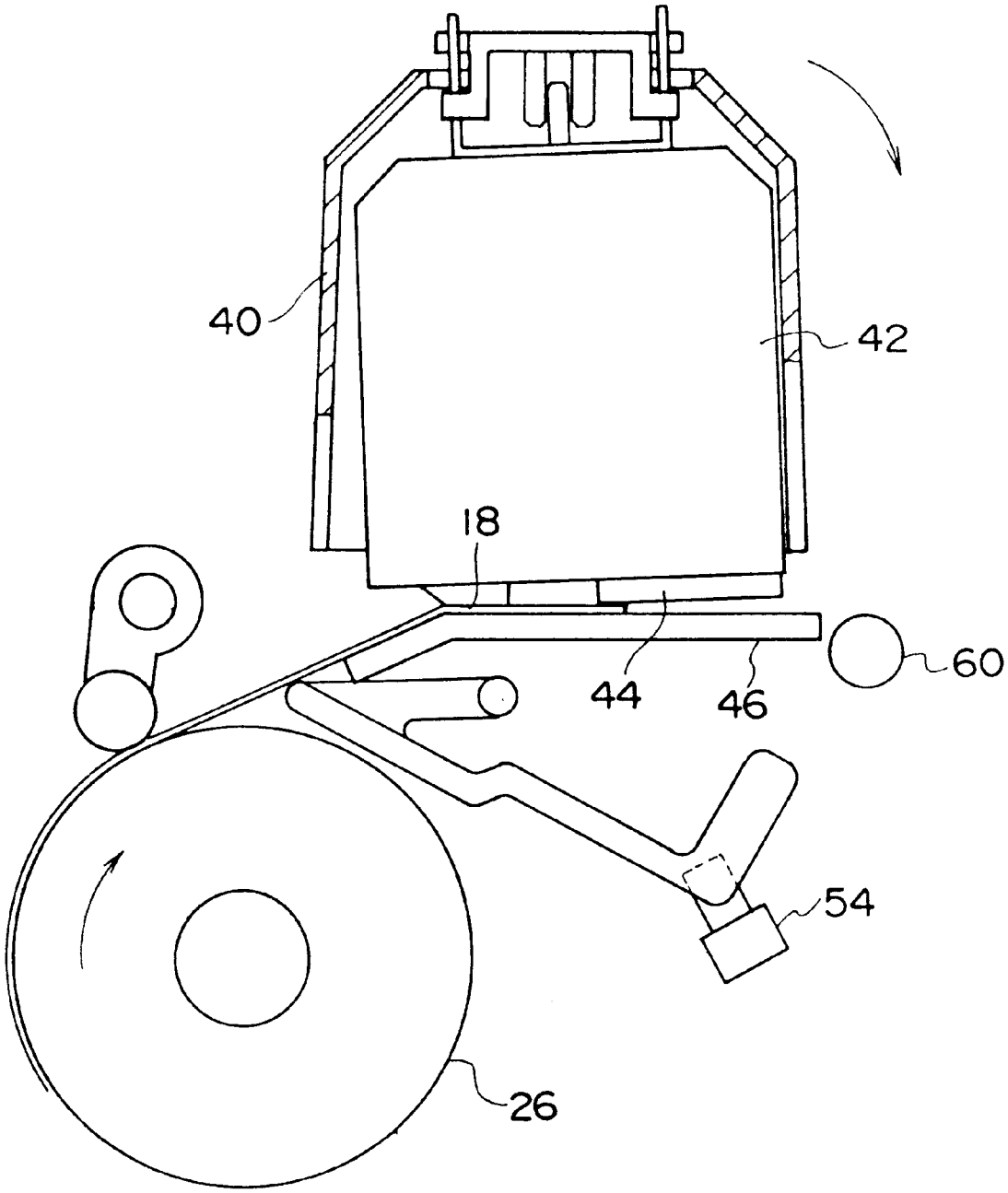
FIG. 11 is a side view showing the water application section of the image forming apparatus according to the present embodiment, and movement thereof.
Figure 12:
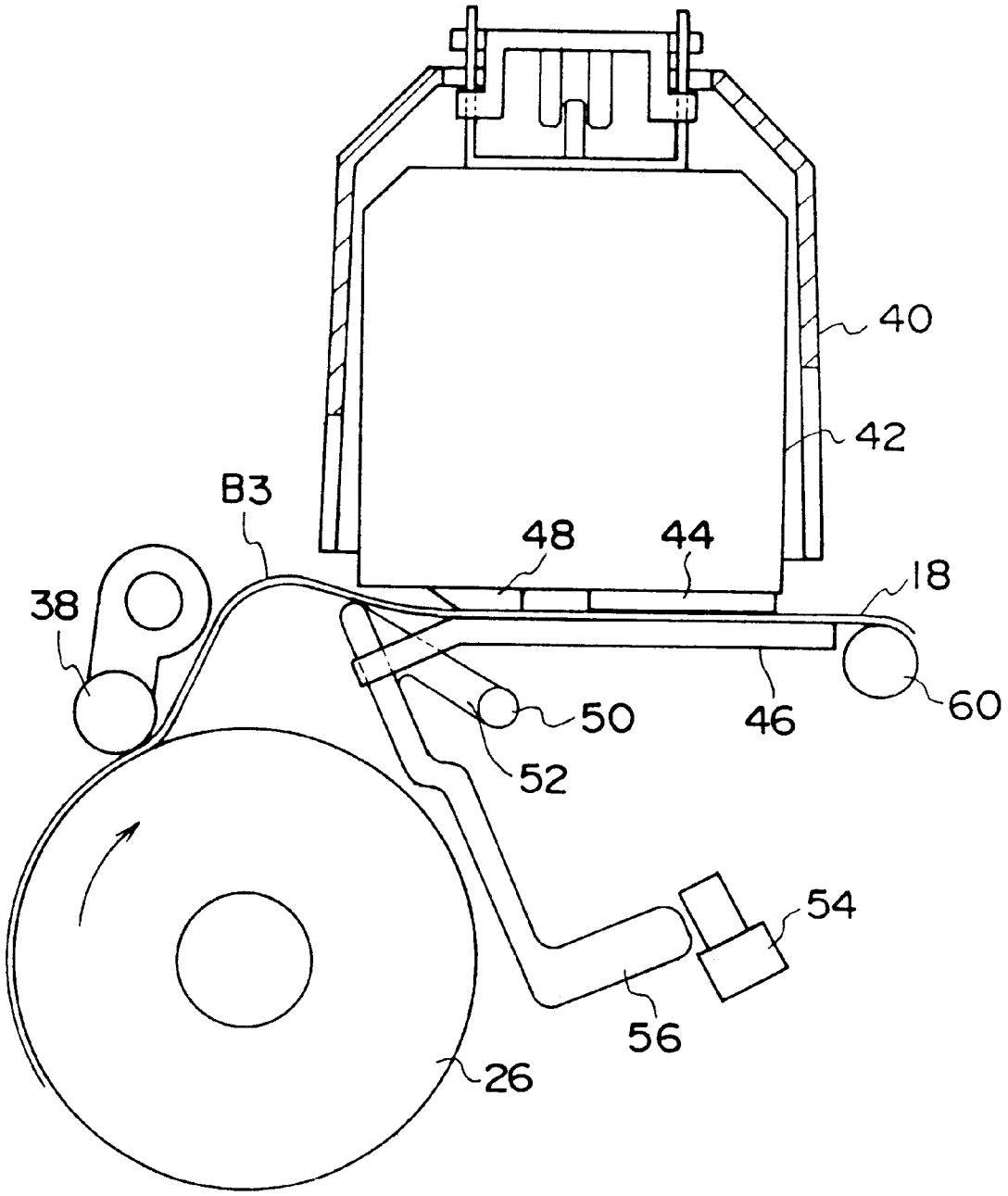
FIG. 12 is a side view showing the water application section of the image forming apparatus according to the present embodiment, and movement thereof.

Further, an upper portion of the application unit 42 is supported at the casing 40 such that the application unit 42 can swing. As illustrated in FIG. 11, when the sponge 44 is lowered, a corner portion thereof initially presses against the photosensitive material 18. As illustrated in FIG. 12, operation is carried out so that the entire surface of the sponge 44 is gradually made to press against the photosensitive material 18. Consequently, air can be prevented from becoming entrained between the sponge 44 and the photosensitive material 18.

At a lower side of the application unit, a surface heater 46, which faces the sponge 44, is provided horizontally. Water is applied to the photosensitive material 18 with the sponge 44 as the photosensitive material 18 is conveyed across the top of the surface heater 46. Further, a distal end portion of the surface heater 46 is bent diagonally downward toward the platen roll 26, so that a corner portion of the surface heater 46 does not scratch the photosensitive material 18. At an upstream side of the surface heater 46, a flocked friction pad 48 is provided. The photosensitive material 18 is interposed between the flocked friction pad 48 and the surface heater 46. The function of forming buffers B3, B4 between the flocked friction pad 48 and the nip roller 38 is thereby carried out by the flocked friction pad 48.

The buffers B3, B4 are detected by a buffer detecting device. This buffer detecting device is structured by a lever portion 52 which is axially supported by a pin 50, and an arm portion 56, which bends from the distal end of the lever portion 52 and extends so as to pass through a photo-sensor 54.

A torsion coil spring (not illustrated) is attached at the pin 50, and energizes the lever portion 52 in the clockwise direction. As shown in FIG. 12, when the buffer is formed, an end portion of the arm portion 56 is separate from the photo-sensor 54. A structure has been adopted wherein as the buffer becomes smaller, the lever portion 52 is pressed by a reverse surface of the photosensitive material 18 to rotate in the counter-clockwise direction, and the arm portion 56 passes through the photo-sensor 54, as shown in FIG. 14.

Figure 14:
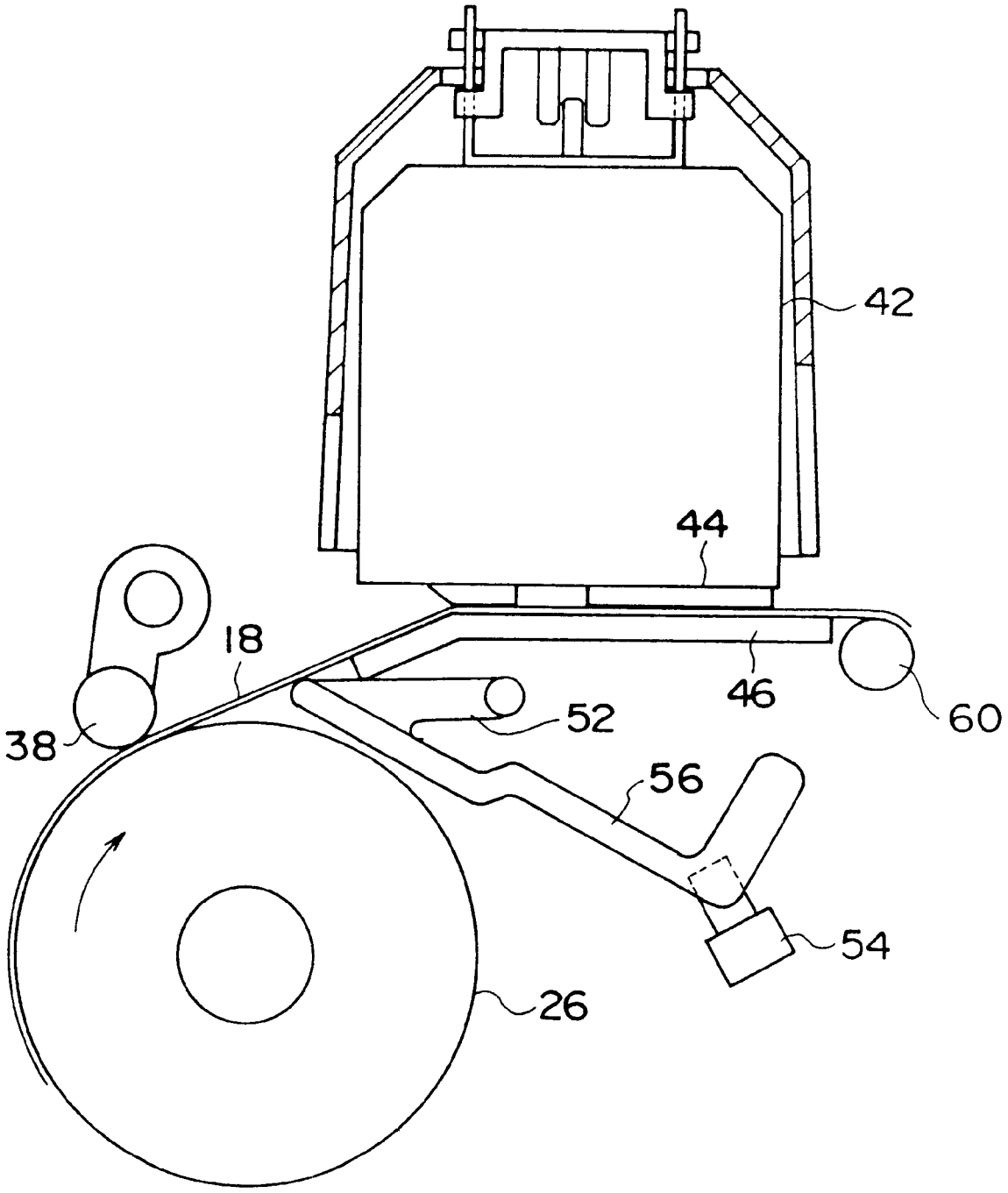
FIG. 14 is a side view showing the water application section of the image forming apparatus according to the present embodiment, and movement thereof.

With this kind of structure, during standby (the time when image forming is not being carried out) the buffer B3, B4 is not formed, and the end portion of the arm portion 56 is in a position shown in FIG. 14. Then, in order to position the leading end portion of the photosensitive material to be exposed next, the photosensitive material is conveyed by the platen roll 26, the buffer B3 shown in FIG. 12 is formed, and conveyance is stopped when the end portion of the arm portion 56 is separate from the photo-sensor 54.

Figure 13:
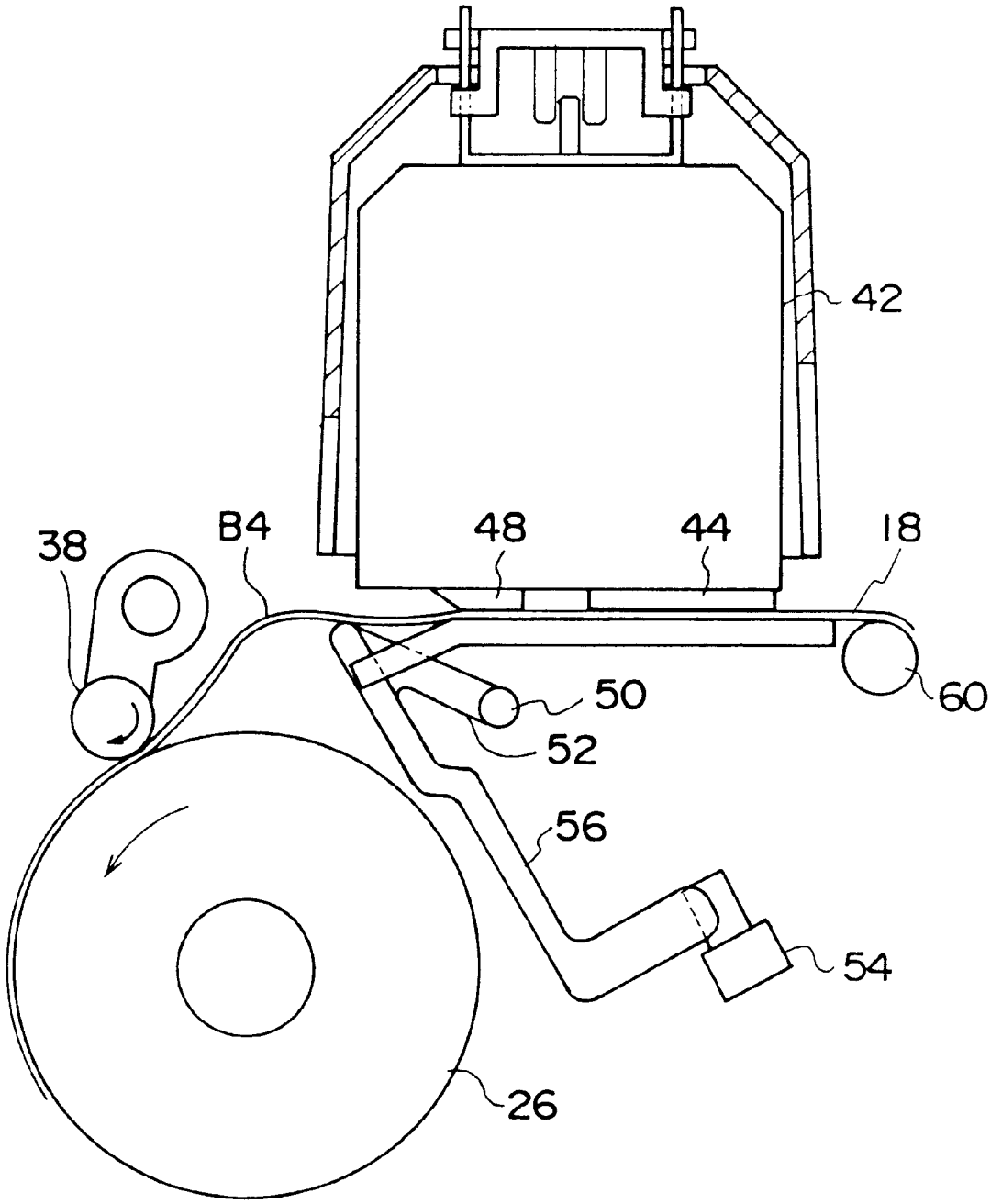
FIG. 13 is a view showing the water application section of the image forming apparatus according to the present embodiment, and movement thereof.

Next, the photosensitive material is conveyed, the buffer B3 is made smaller and the buffer B4 is formed, as shown in FIG. 13. Conveyance is stopped when the end portion of the arm portion 56 passes through the photo-sensor 54. As a result, the length of the photosensitive material 18 between a laminating roller 58 (to be described later, see FIG. 1) and the nip roller 38 is fixed, and the portion of the photosensitive material 18 to be exposed next can be positioned.

Further, although the surface heater 46 is heated to approximately 40° C., there are no problems in terms of quality even if the photosensitive material 18 comes into contact therewith. Image quality is not affected even if the photosensitive material 18 is pulled back and then exposed.

As shown in FIG. 1, the photosensitive material 18 is guided by a turn roller 60 that is axially supported so as to be rotatable, and is wound with a fixed pressure about a heating drum 64, by the laminating roller 58 and a stripping turn roller 62. The heating drum 64 has built therein a halogen lamp, an infrared ray heater, or the like. Here, an image-receiving paper 66, which will be described later, is laminated onto the top surface of the photosensitive material 18. The photosensitive material 18 and the image-receiving paper 66 are then wound at the heating drum 64 and conveyed while being heated, so that an image is thermally transferred. In this way, tension is imparted to the photosensitive material 18 with the laminating roller 58 and the stripping turn roller 62. As a result, an endless belt, which is used conventionally, is unnecessary. Further, since thermal transfer is carried out during conveyance with the rotating heating drum 64, there is no need to change the radius of the heating drum in accordance with the image size.

The image receiving paper 66 that has been wound around a supply reel 70 is set in an image-receiving material magazine 68. The image receiving paper 66 is then pulled out with nip rollers 72, and after being cut into a predetermined length with a cutter 74, is guided to conveying rollers 76 and a guide plate 78. The leading end portion of the image receiving paper 66 is made to standby at positioning rollers 80, is aligned with the laminating roller 58, and thereafter, is laminated onto the photosensitive material 18.

Next, details of a thermal transfer developing section will be given.

Figure 15:
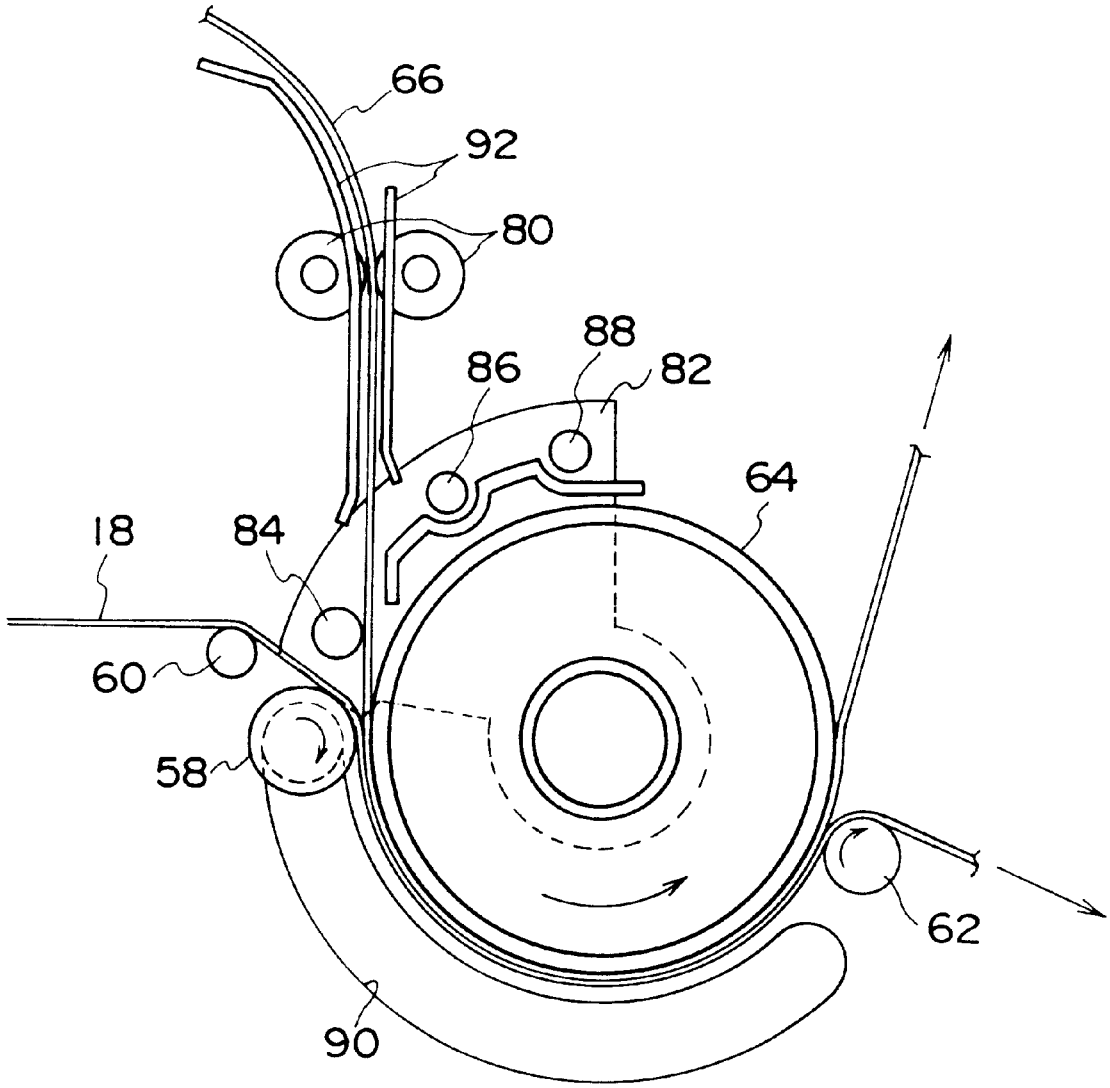
FIG. 15 is a side view showing a thermal development section of the image forming apparatus according to the present embodiment, and movement thereof.

As shown in FIG. 15, a fan-shaped rotating arm 82 extends in the radial direction at each of two end portions of the heating drum 64. A center portion of the rotating arm 82 is supported at a shaft portion of the heating drum 64 so as to be rotatable. This rotating arm 82 is structured so as to rotate with a timing that will be described later, due to a driving mechanism (not illustrated).

Pulling rollers 84, 86, 88 are rotatably supported at the rotating arm 82, along an arc that is concentric with the heating drum 64. As shown in FIG. 15, when the rotating arm is in a standby position, the image receiving paper 66 passes between the pulling roller 84, 86 to be wound at the heating drum 64.

Further, a guiding groove 90 is formed in an arc-form that is concentric with the heating drum 64, at a periphery of the heating drum 64. A shaft portion of the laminating roller 58 is guided by the guiding groove 90, and the laminating roller 58 moves about the heating drum 64 while pressing the photosensitive material 18 and the image receiving paper 66 onto the heating drum 64.

Further, the laminating roller 58 is connected with the rotating arm 82 by a connecting member (not illustrated), and is structured so as to move along the guiding groove 90 integrally with the rotating arm 82.

Next, operation of the thermal transfer developing section will be explained.

As shown in FIG. 15, during continuous printing, the leading end portion of the sheet-form image receiving paper is brought to a temporary standstill by the positioning rollers 80 and is positioned, and is then aligned at a nipping position between the laminating roller 58 and the heating drum 64.

Next, the image receiving paper 66 and the photosensitive material 18 is laminated at the heating drum 64 with the laminating roller 58 and the stripping turn roller 62. As the image receiving paper 66 and the photosensitive material 18 are conveyed while being heated, the image on the photosensitive material 18 is thermally transferred to the image receiving paper 66.

In this way, in the case of continuous printing, thermal transfer processing is carried out in a state in which the laminating roller 58 and the rotating arm 82 are kept at a standstill without being moved.

After continuous printing is ended, or in a case in which only one sheet was printed, if the photosensitive material 18 is conveyed out as is the following occurs. When thermal transfer to the image receiving paper 66 is effected, regions of the photosensitive material 18 on which an image has not been formed through imagewise exposure contacts the heating drum 64 as the heating drum rotates, and these regions can not be used in the subsequent image processing.

Figure 16:
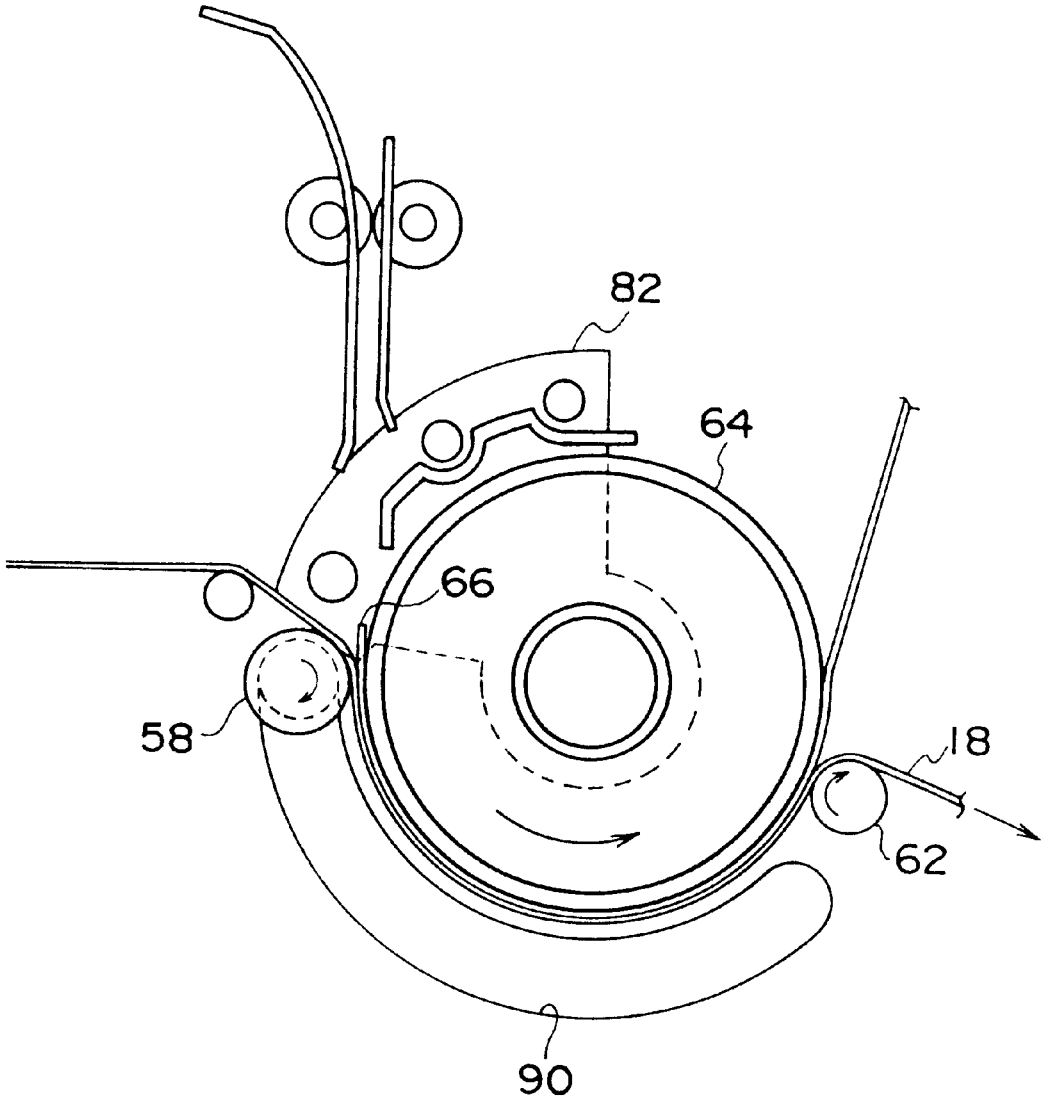
FIG. 16 is a side showing the thermal development section of the image forming apparatus according to the present embodiment, and movement thereof.
Figure 17:
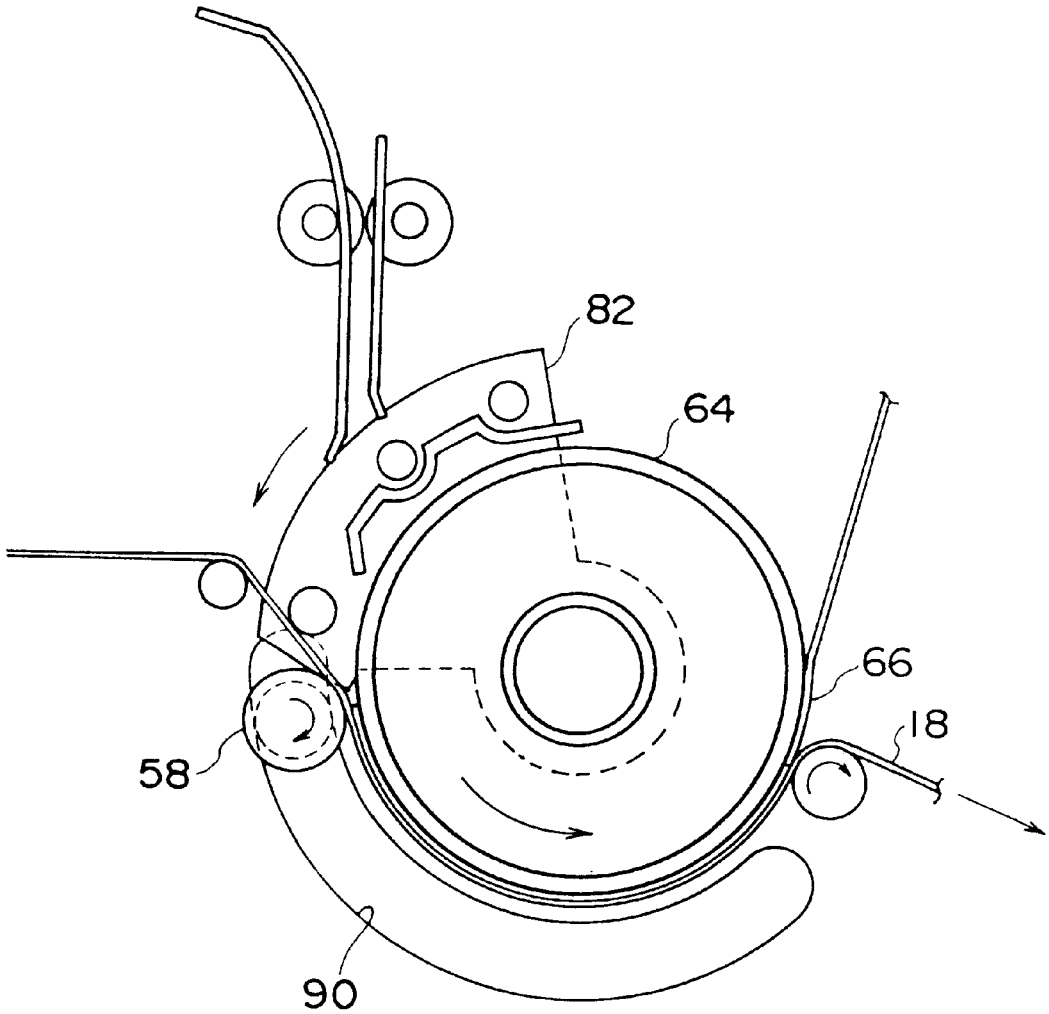
FIG. 17 is a side view showing the thermal development section of the image forming apparatus according to the present embodiment, and movement thereof.

Therefore, after a trailing end portion of the image receiving paper 66 contacts the heating drum 64 as shown in FIG. 16, the rotating arm 82 and the laminating roller 58 move about the heating drum 64 along the guiding groove 90 at the same rotating speed as the heating drum 64, with the photosensitive material 18 and the image receiving paper 66 interposed between the laminating roller 58 and the heating drum 64, as shown in FIG. 17.

Figure 18:
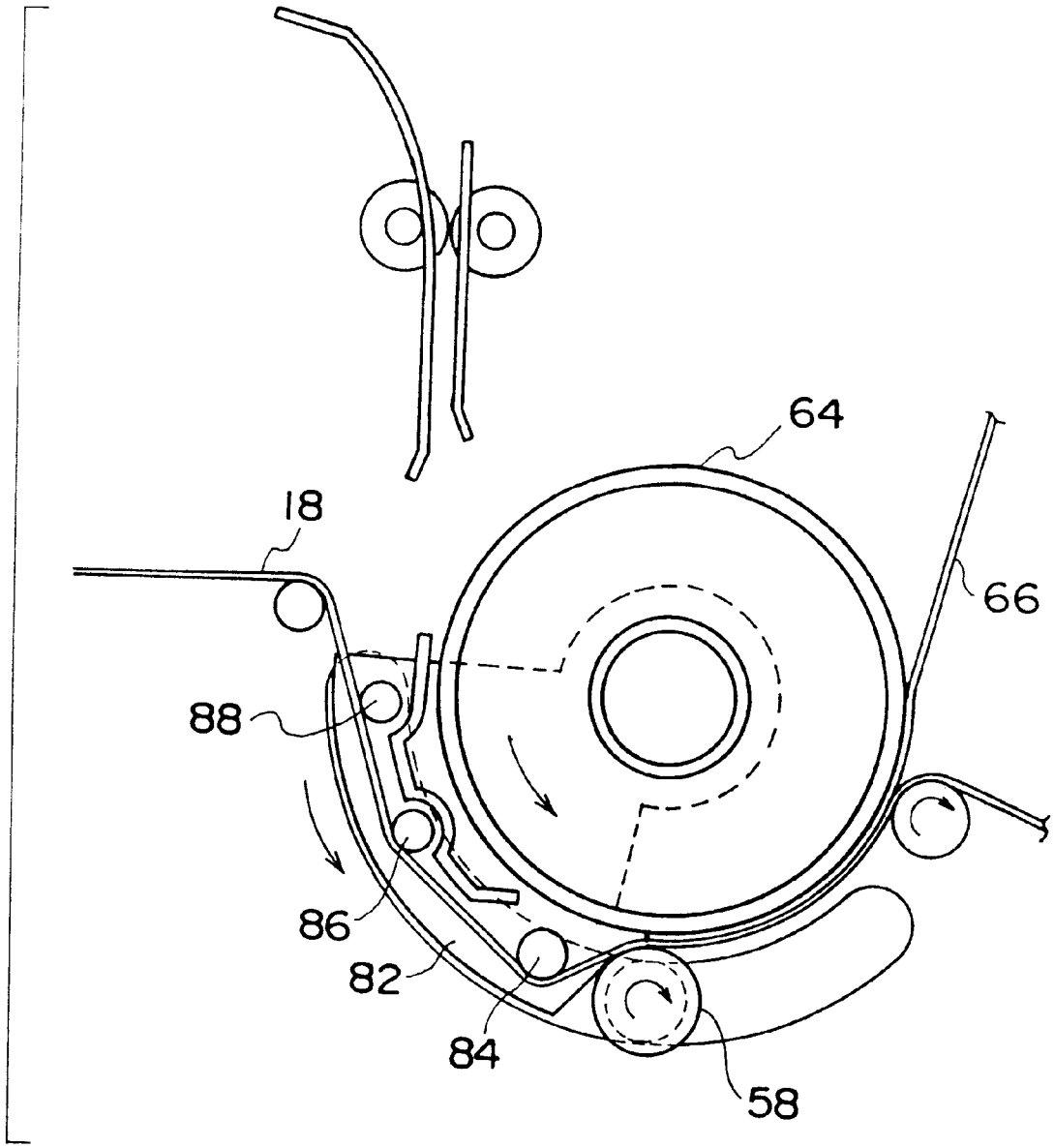
FIG. 18 is a side view showing the thermal development section of the image forming apparatus according to the present embodiment, and movement thereof.

As a result, as shown in FIG. 18, the pulling rollers 84, 86, 88 pull the trailing end side of the photosensitive material 18 apart from the heating drum 64, in conjunction with movement of the laminating roller 58.

Accordingly, the photosensitive material 18 that has not yet been exposed does not contact the heating drum 64, and can be used in the next image formation.

Figure 19:
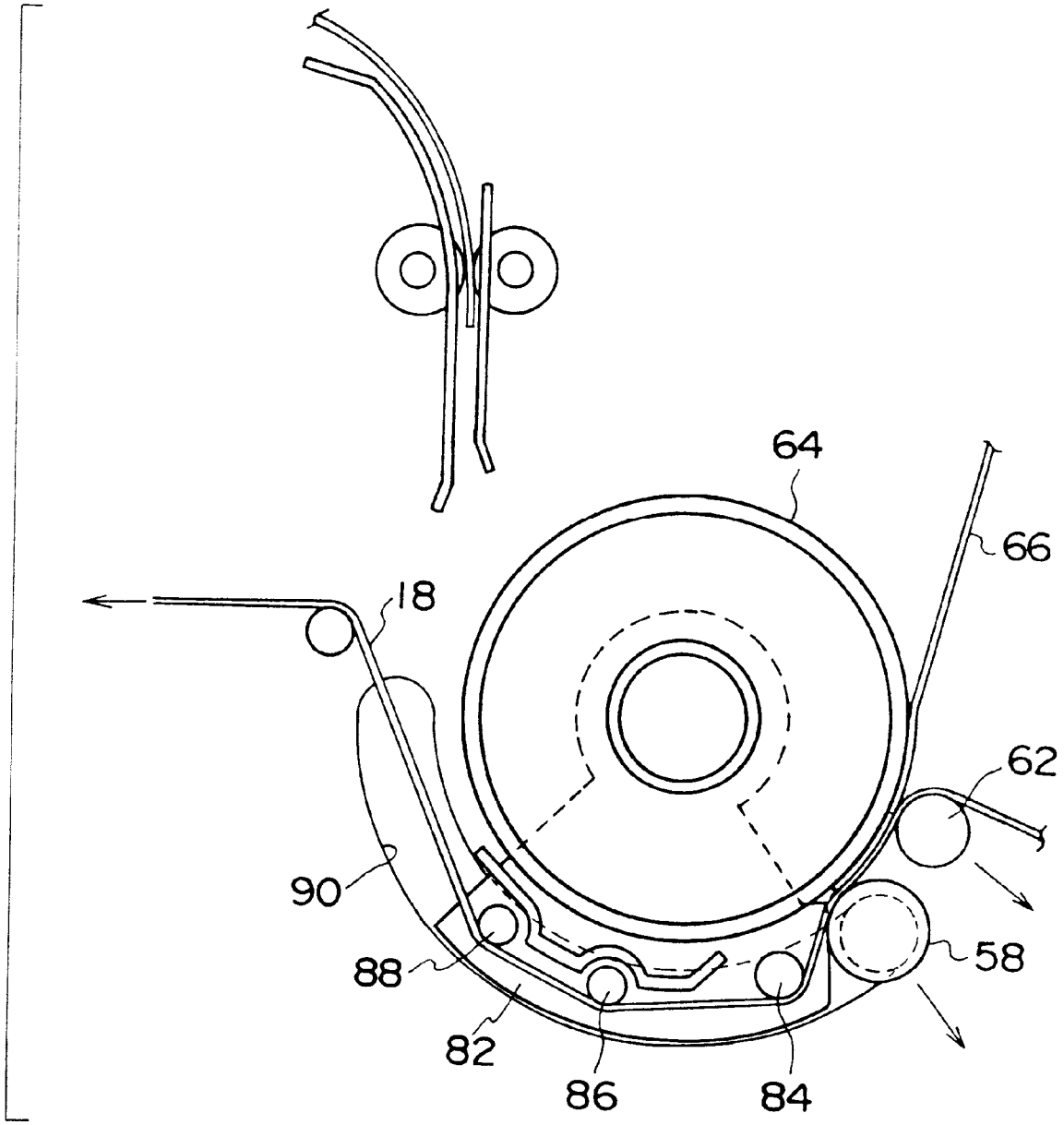
FIG. 19 is a side view showing the thermal development section of the image forming apparatus according to the present embodiment, and movement thereof.

As shown in FIG. 19, after the laminating roller 58 moves until it reaches an end portion of the guiding groove 90, the image receiving paper 66 and the photosensitive material 18 which has been laminated together are separated at the location of the stripping turn roller 62, and the image receiving paper 66, which is towards the heating drum 64, is stripped from the heating drum 64 with a stripping pawl (not illustrated). Then, the image receiving paper 66 which has been stripped from the heating drum 64 is guided to conveying rollers 94 and a guide plate 96, and is conveyed to a pan 98 (see FIG. 1).

At this time, nipping action of the laminating roller 58 is released, the nip rollers 20, 22 rotate in the reverse direction, and the photosensitive material 18 that has not yet been used is pulled back. Thereafter, the rotating arm 82 and the laminating roller 58 returns to the state shown in FIG. 15, and waits for the next thermal transfer instruction.

The photosensitive material 18 from which an image has been transferred and which has been used is conveyed by nip rollers 102, 104, and is wound about a disposal reel 100. In this way, since the photosensitive material 18 is conveyed to the disposal reel 100 from the supply reel 16 without being cut, the photosensitive material 18 itself functions as an endless belt that applies fixed pressure to the image receiving paper 66. Further, since the photosensitive material 18 is wound without being cut into the form of sheets, processing of the photosensitive material 18 that has been used is simplified.

Here, a structure of the disposal reel 100 will be explained.

Figure 20:
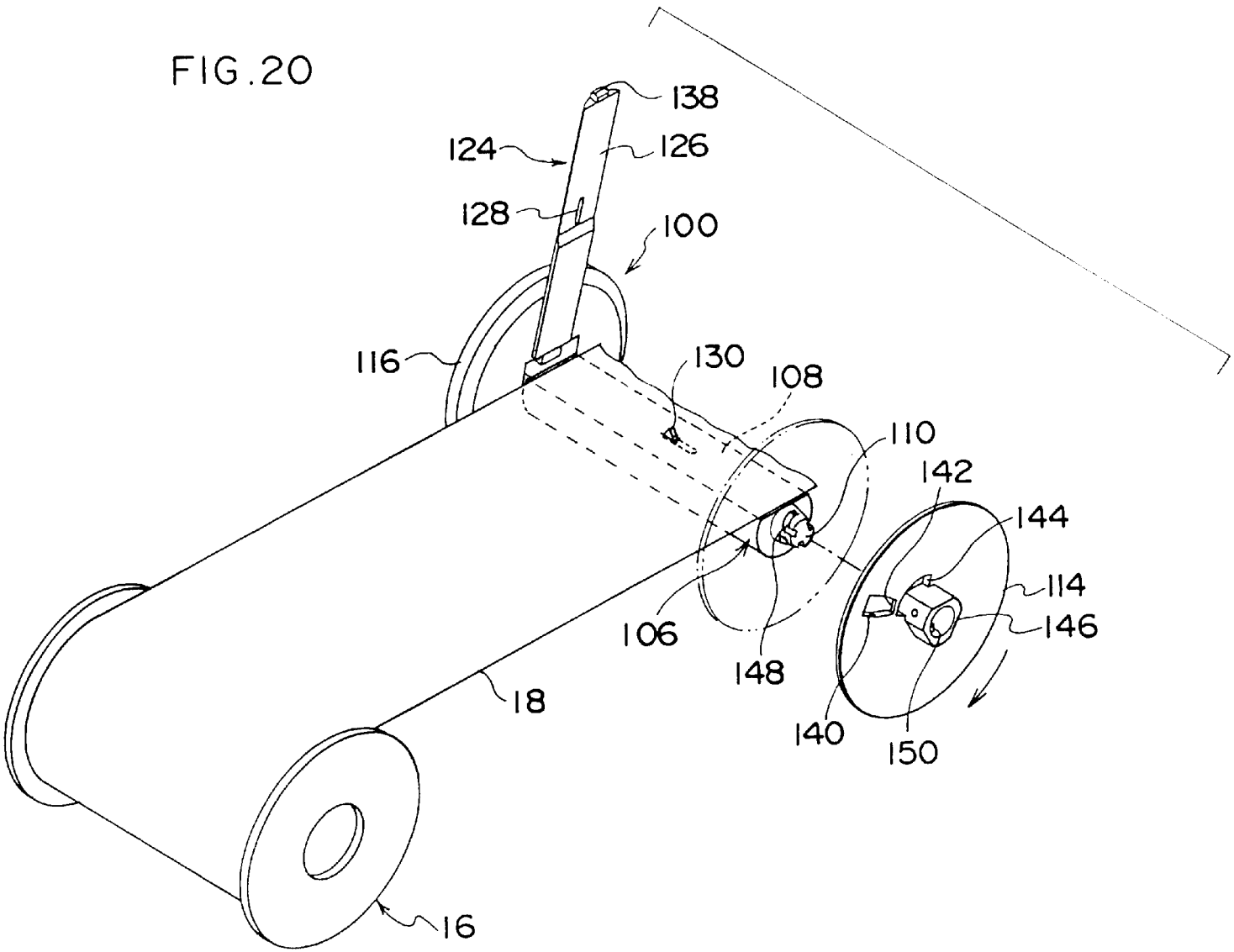
FIG. 20 is a perspective view showing a disposal reel of the image forming apparatus according to the present embodiment.
Figure 21:
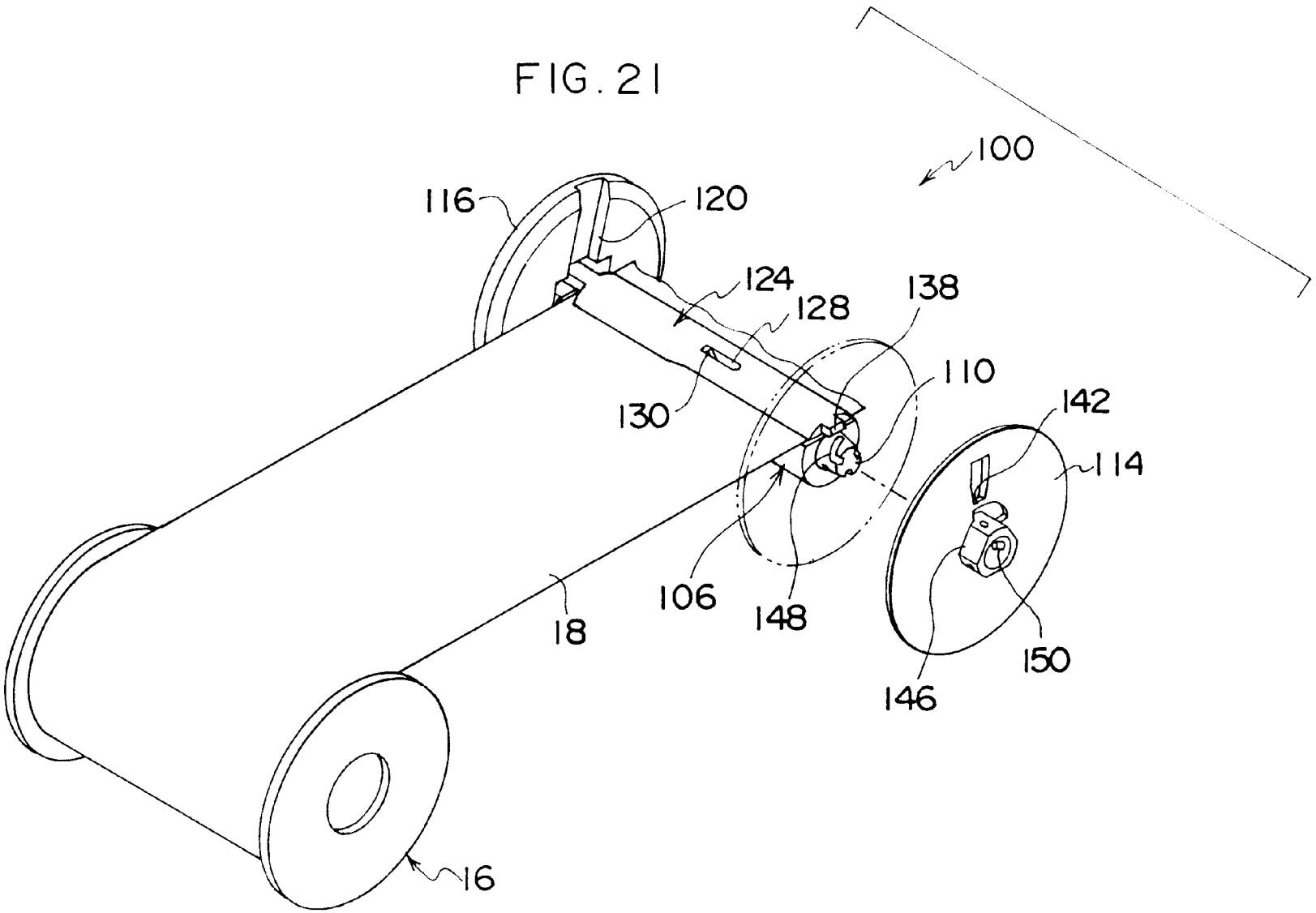
FIG. 21 is a perspective view showing the disposal reel of the image forming apparatus according to the present embodiment.
Figure 22:
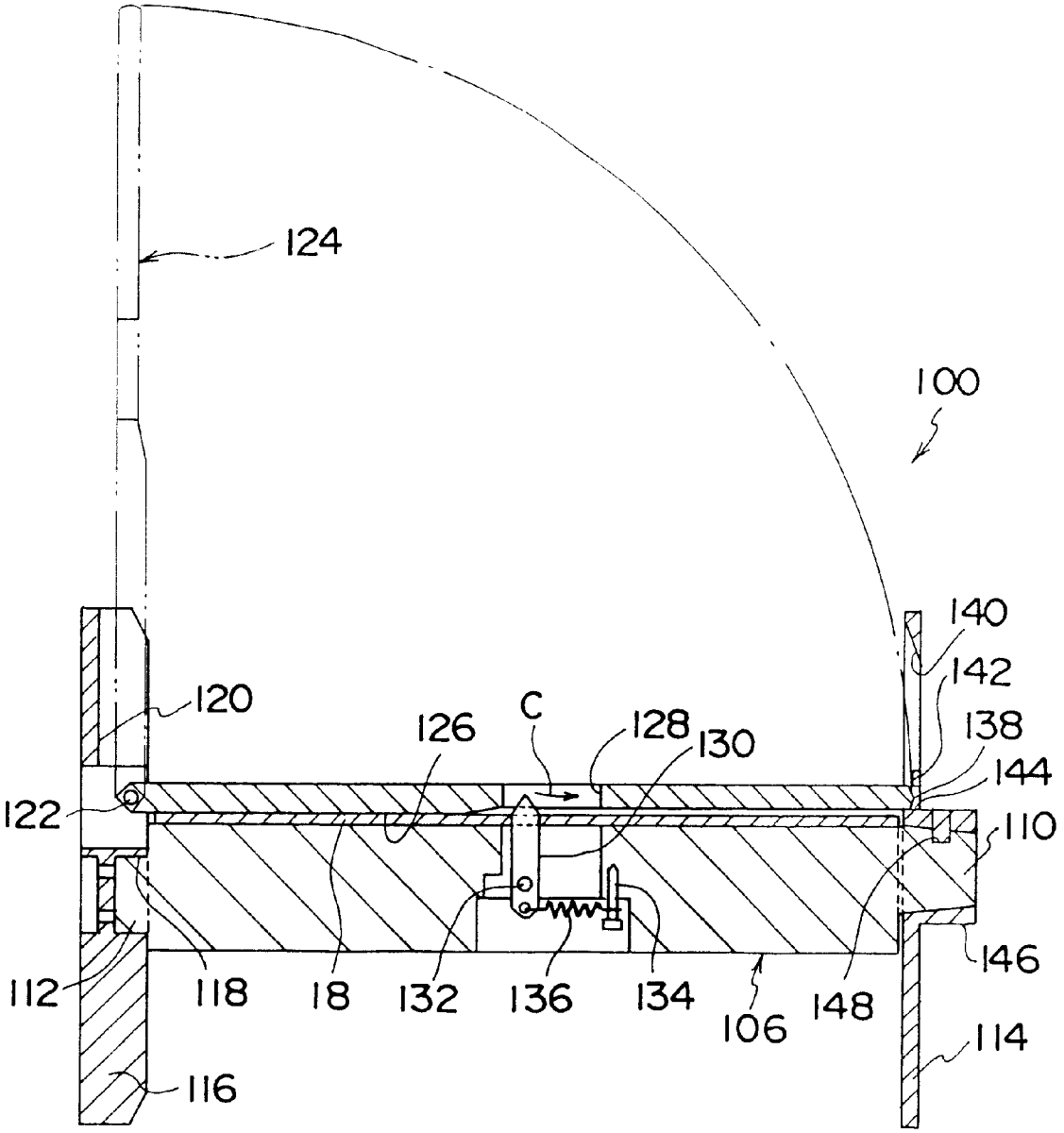
FIG. 22 is a cross-sectional view showing the disposal reel of the image forming apparatus according to the present embodiment.

As shown in FIGS. 20 to 22, a substantially cylindrical core 106 is provided, a portion of the peripheral surface of which being cut in a flat plane along the shaft direction, as an interposing face 108. A shaft portion 112 having a small diameter is formed at an end portion of this core 106. This shaft portion 112 is fit into a fitting hole 118 formed in a cylindrical flange 116.

A wide relief groove 120 is formed at an inner side of the flange 116, from an intermediate portion thereof toward a radial direction (direction moving away from the interposing face 108). A pin 122 is provided in a protruding condition at a groove wall of the relief groove 120. An end of a crescent-shaped holding member 124 is rotatably connected to this pin 122.

A pressing face 126 is formed at the holding member 124, which holds the photosensitive material 18 against the interposing face 108 when the holding member 124 is collapsed towards the core 106. Further, as shown in FIG. 20, the holding member 124, when stood upright, is made to fit into the relief groove 120 in an upright position, so as not to be an obstruction when the photosensitive material 18 is set on the interposing face 108.

At an intermediate portion of the pressing face 126, a long aperture 128 is formed. As shown in FIG. 22, when the holding member 124 is collapsed toward the core 106, an engaging pawl 130 that pierces through the photosensitive material 18 engages with the long aperture 128.

The engaging pawl 130 is supported with a pin 132 provided at an internal portion of the core 106, such that the engaging pawl 130 can swing in the shaft direction of the core 106 (within the long aperture 128). An extension spring 136, one end of which is fixed by a pin 134, is connected to a lower end side of the engaging pawl 130. The extension spring 136 energizes the engaging pawl 130 such that the engaging pawl 130 rotates in the counterclockwise direction with the pin 132 as the center of rotation.

Due to this structure, the engaging pawl 130 is ordinarily maintained in an upright condition. When the photosensitive material 18 is pulled in the left/right direction, the engaging pawl collapses toward the long aperture 128 and is separated from the photosensitive material 18.

A free end side viewing from the long aperture 128 of the holding member 124 is slightly thinner, and when the photosensitive material 18 is held between the holding member 124 and the interposing face 108, space is left therebetween. An engaging body 138 is provided at a free end portion of the holding member 124 so as to protrude therefrom. When the holding member 124 is inclined toward the core 106 side, this engaging body 138 enters a guiding hole 140 (to be described later) formed in the flange 114, passes over a partition portion 142, and enters a locking hole 144, and the holding member 124 is thereby locked.

A substantially triangular-pole-shaped boss 146 is provided at the flange 114 so as to protrude towards an outer side thereof. A cone-shaped shaft portion 110, which is provided so as to protrude from the other end portion of the core 106, is inserted from an inner side of the boss 146.

Cam grooves 148 are formed in a spiral form at an outer peripheral surface of the shaft portion 110. When the shaft portion 110 is inserted into the boss 146, a lock pin 150, which is provided at the boss 146 so as to protrude from an inner side thereof, enters the cam groove 148. In conjunction with rotation of the boss 146, the flange 114 is guided to a locked position.

Further, the fan-shaped locking hole 144 is formed at a periphery of the boss 146. When the boss 146 is rotated, a wall forming the locking hole 144 locks the engaging body 138 of the holding member 124.

Next, a method of handling the disposal reel 100 will be explained.

As shown in FIG. 20, the holding member 124 is placed in an upright position, and a leading end portion of the photosensitive material 18, which has been unwound from the supply reel 16, is pressed against the engaging pawl 130 so that the engaging pawl 130 passes therethrough. The photosensitive material 18 is thus prevented from inadvertently coming apart from the core 106.

Next, as shown in FIG. 21, the holding member 124 is collapsed toward the core 106. When the photosensitive material 18 is held between the interposing face 108 and the pressing face 108, a distal end portion of the engaging pawl 130 enters the long aperture 128.

Here, the flange 114 is attached to the shaft portion 110, by matching the respective positions of the lock pin 150 and the cam groove 148, and then turning the boss 146 clockwise. Accordingly, the wall forming the locking hole 144 moves to a position where it presses down the engaging pawl 138 of the holding member 124, and the flange 114 is fastened at the shaft portion 110.

Figure 23:
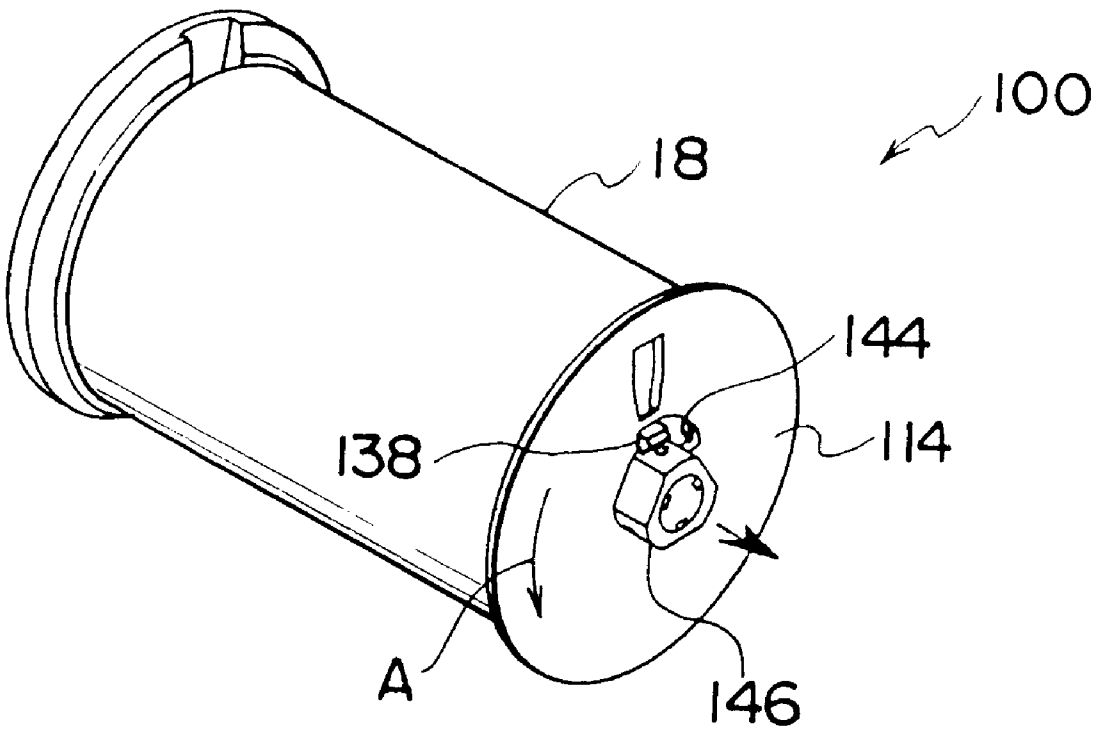
FIG. 23 is a perspective view showing the disposal reel of the image forming apparatus according to the present embodiment.
Figure 24:
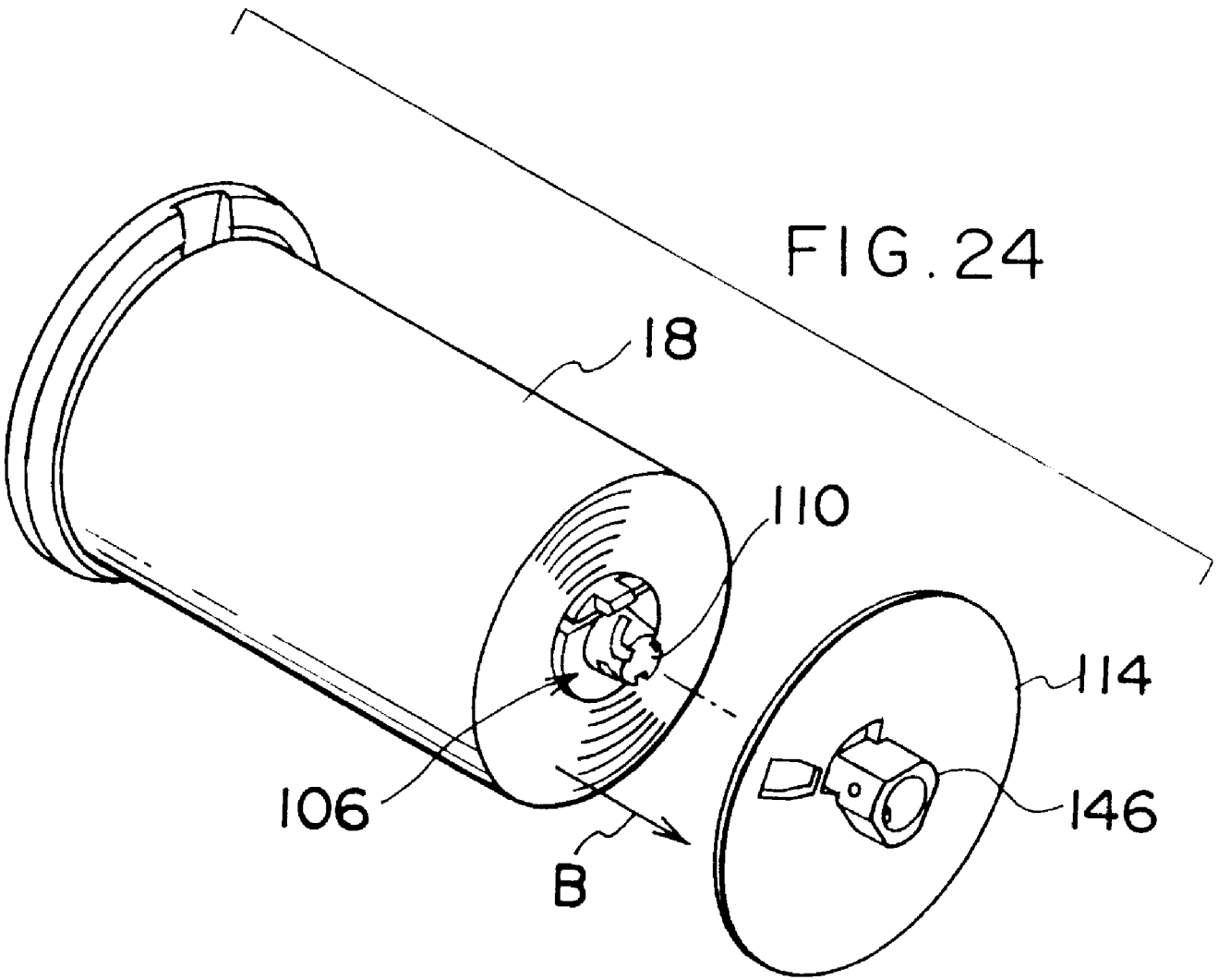
FIG. 24 is a perspective view showing the disposal reel of the image forming apparatus according to the present embodiment.

As shown in FIG. 23, in order to remove the photosensitive material 18, which has been used and is wound around the disposal reel 100, from the core 106 and the holding member 124, the boss 146 is first rotated counter-clockwise (the direction of arrow A). As a result, the lock pin 150 becomes disengaged by being slid along the cam groove 148. As shown in FIG. 24, the flange 114 can then be removed from the shaft portion 110.

When the photosensitive material 18, which has been used and is in the form of a roll, is pulled out in the direction of the shaft (i.e., the direction of arrow B), the engaging pawl 130 is collapsed in the direction of arrow C in FIG. 22 and is separated from the photosensitive material 18. Thus, the photosensitive material 18 can be easily removed, i.e., substantial removal force is not required.

Next, a procedure of exchanging the photosensitive material 18 will be explained, with reference to FIGS. 3 to 9.

Figure 3:
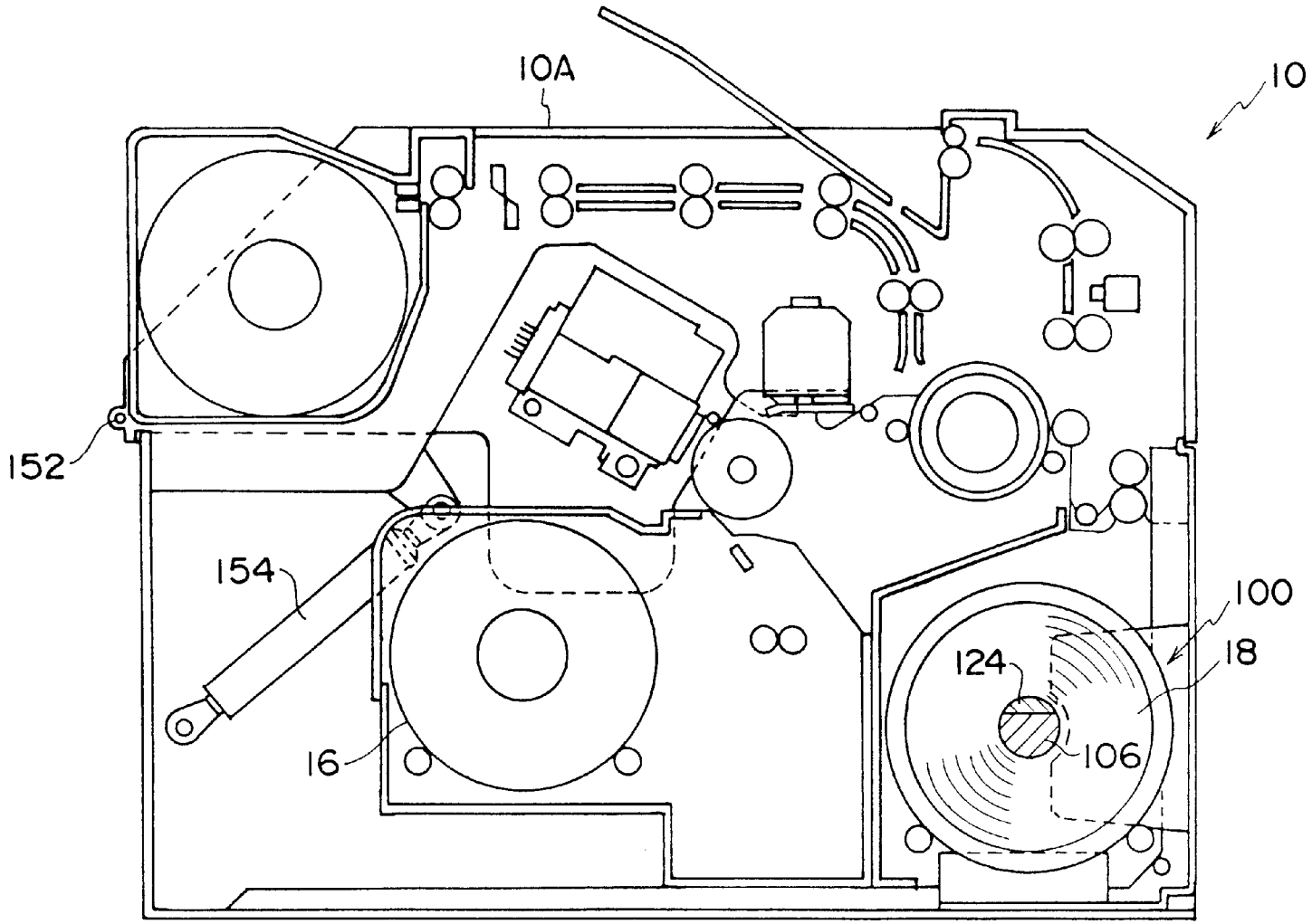
FIG. 3 is a side view showing the entire structure of the image forming apparatus according to the present embodiment, and an operating procedure thereof.
Figure 4:
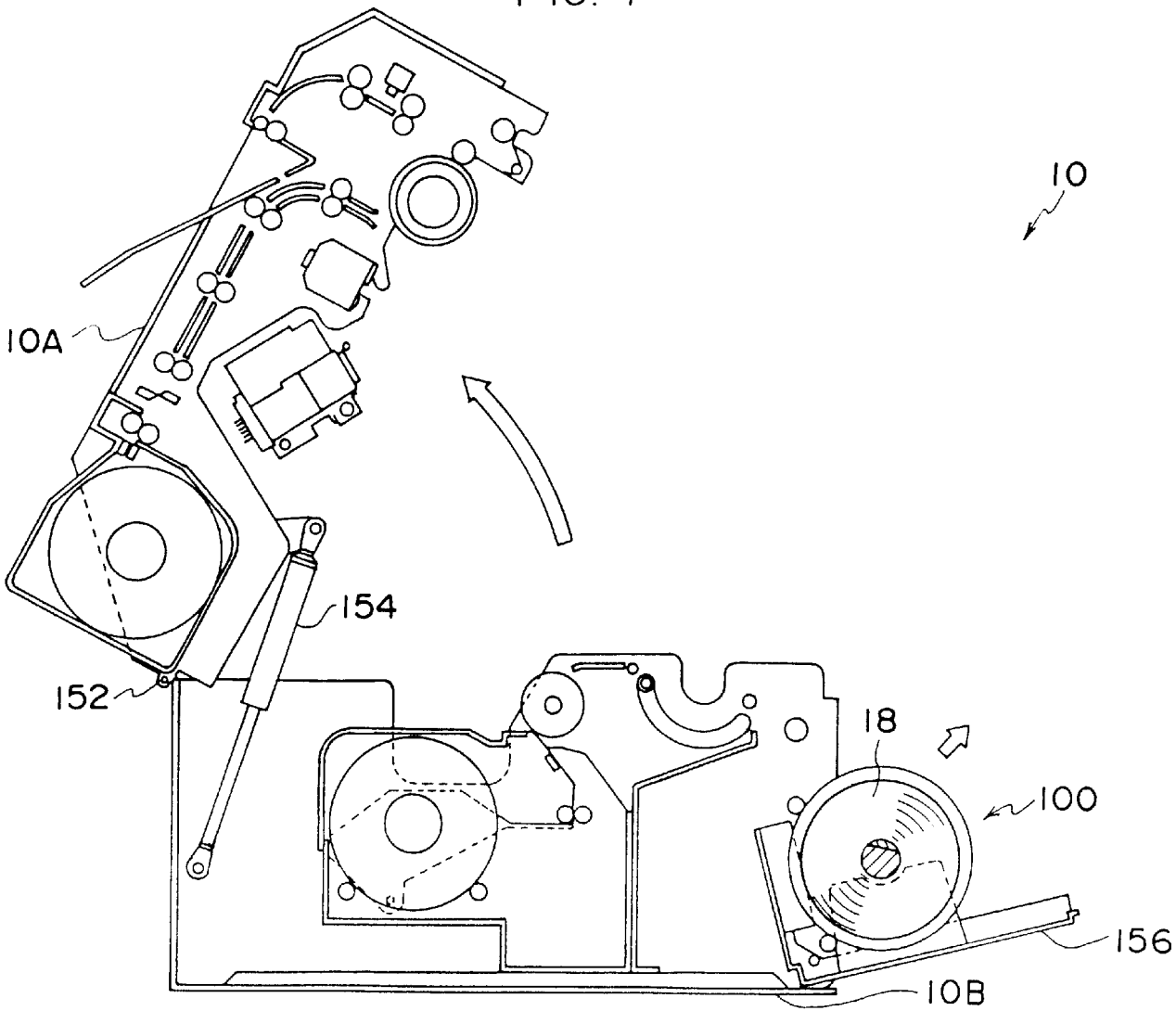
FIG. 4 is a side view showing the entire structure of the image forming apparatus according to the present embodiment, and an operating procedure thereof.

After the photosensitive material 18 is completely taken up by the disposal reel 100 from the supply reel 16 as shown in FIG. 3, an upper body section 10A of the image forming apparatus 10 is opened, by pivoting the upper body section 10A with a hinge portion 152 as a center. At this time, an air damper 154 operates to push upwards the upper body section 10A. Therefore, excessive force is not necessary to maintain the released state of the upper body section 10A. A disposal magazine 156 is then opened, and the disposal reel 100 is removed.

Figure 5:
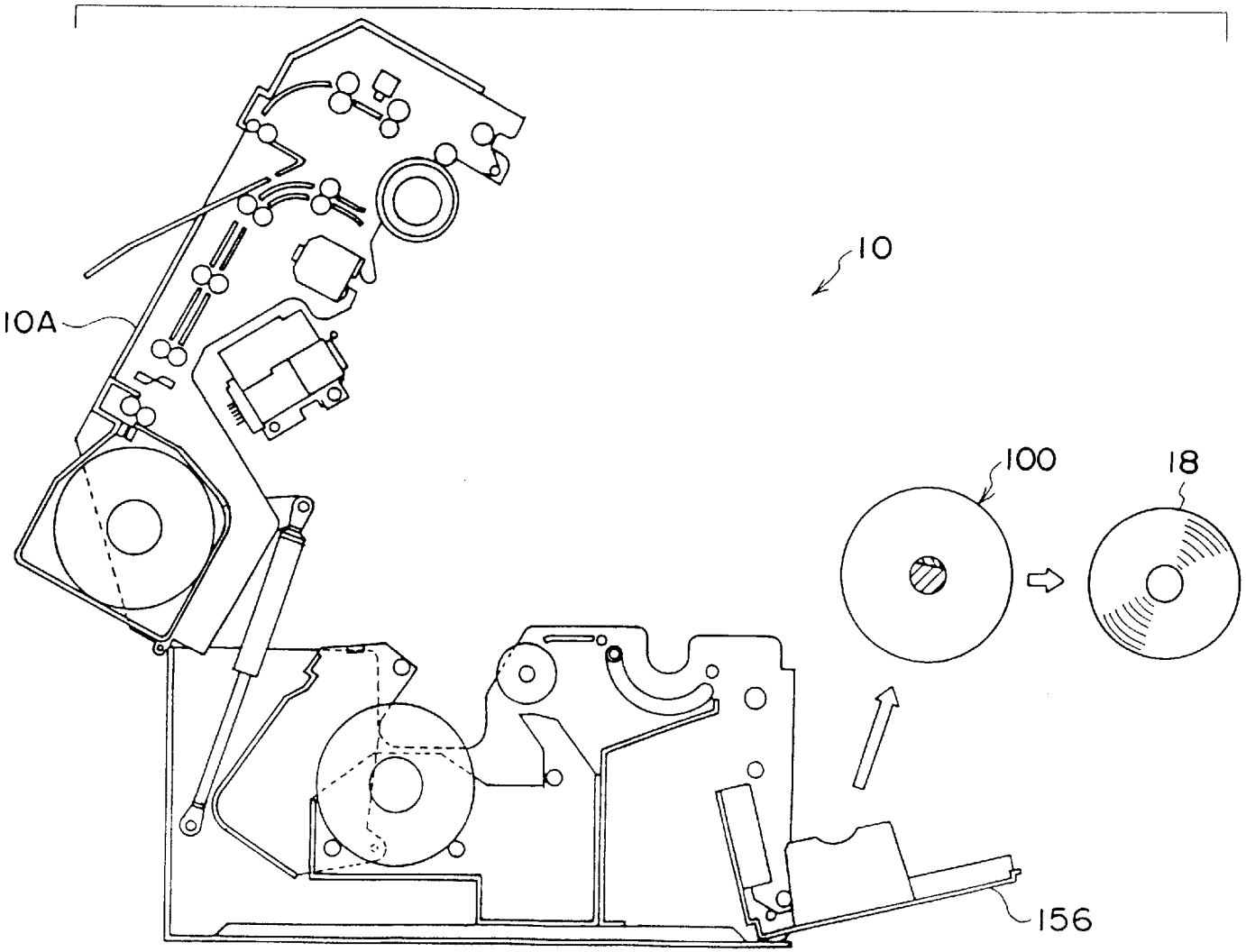
FIG. 5 is a side view showing the entire structure of the image forming apparatus according to the present embodiment, and an operating procedure thereof.

Next, as shown in FIG. 5, the photosensitive material 18, which has been wound into the form of a roll, is removed from the disposal reel 100. Since details of this procedure have been already explained, further explanation will be omitted.

Figure 6:
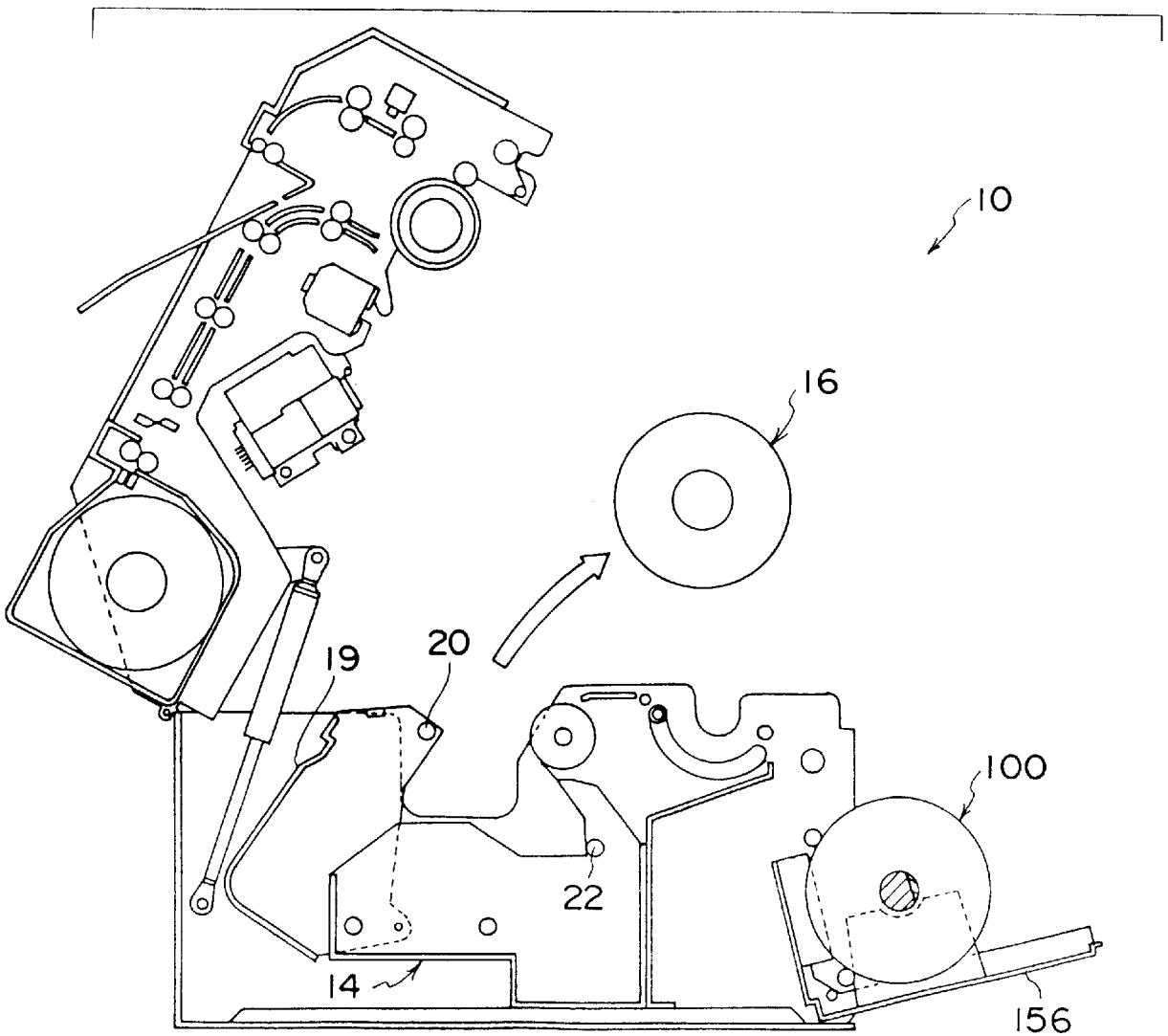
FIG. 6 is a side view showing the entire structure of the image forming apparatus according to the present embodiment, and an operating procedure thereof.

As shown in FIG. 6, the disposal reel 100 from which the used photosensitive material 18 has been removed is loaded into the disposal magazine 156. The top cover 19 of the photosensitive material magazine 14 is opened, and the empty supply reel 16 is removed.

Figure 7:
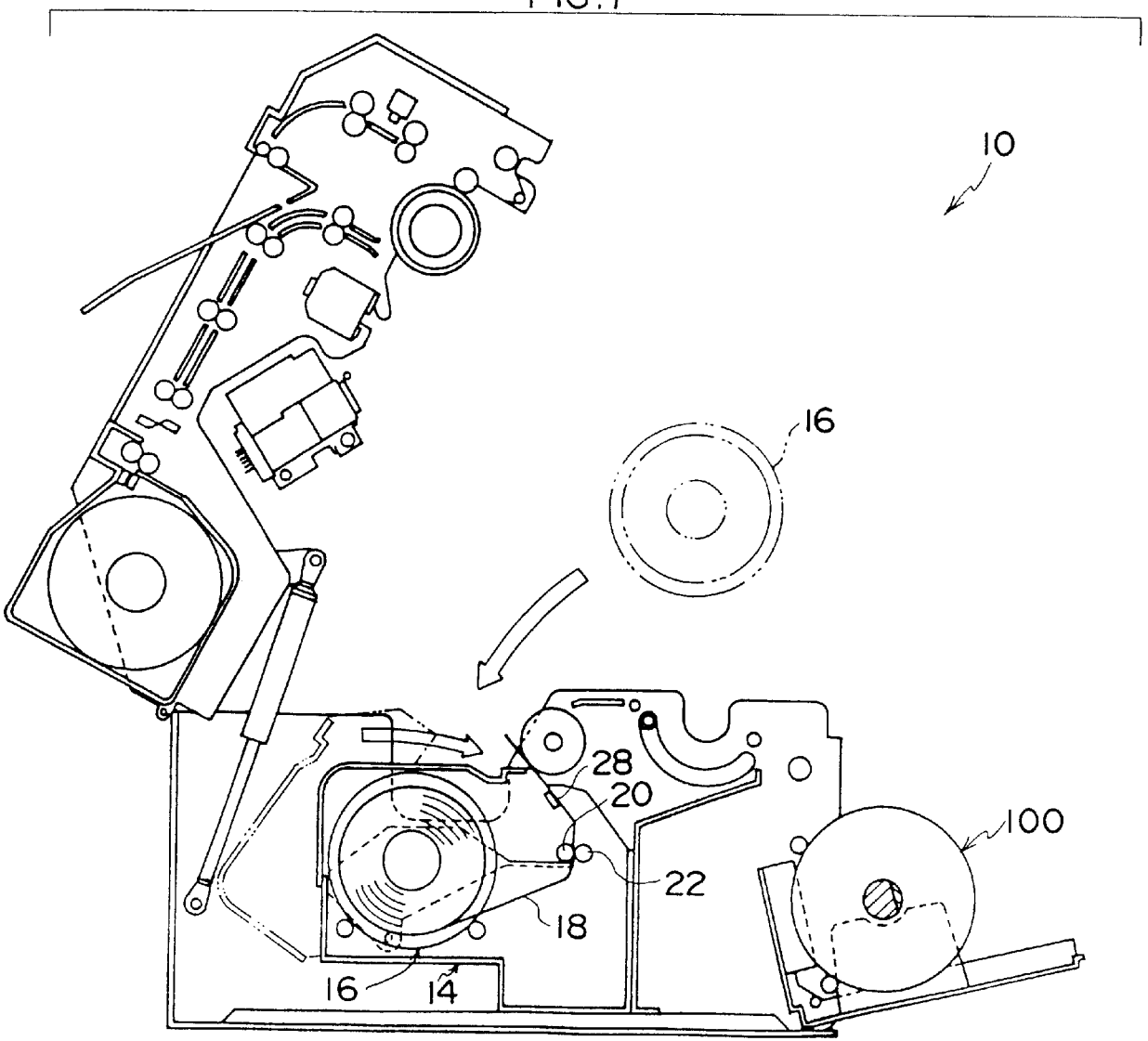
FIG. 7 is a side view showing the entire structure of the image forming apparatus according to the present embodiment, and an operating procedure thereof.

Next, as shown in FIG. 7, the new supply reel 16 having the photosensitive material 18 wound around it is loaded into the photosensitive material magazine 14, and the top cover 19 is closed. In conjunction with the photosensitive material 18 being nipped by the nip rollers 20, 22, the photosensitive material 18 is shielded from light by the light-shielding member 28. At this time, a leading end portion of the photosensitive material 18 is pulled out to a degree where it emerges from the photosensitive material magazine 14.

Figure 8:
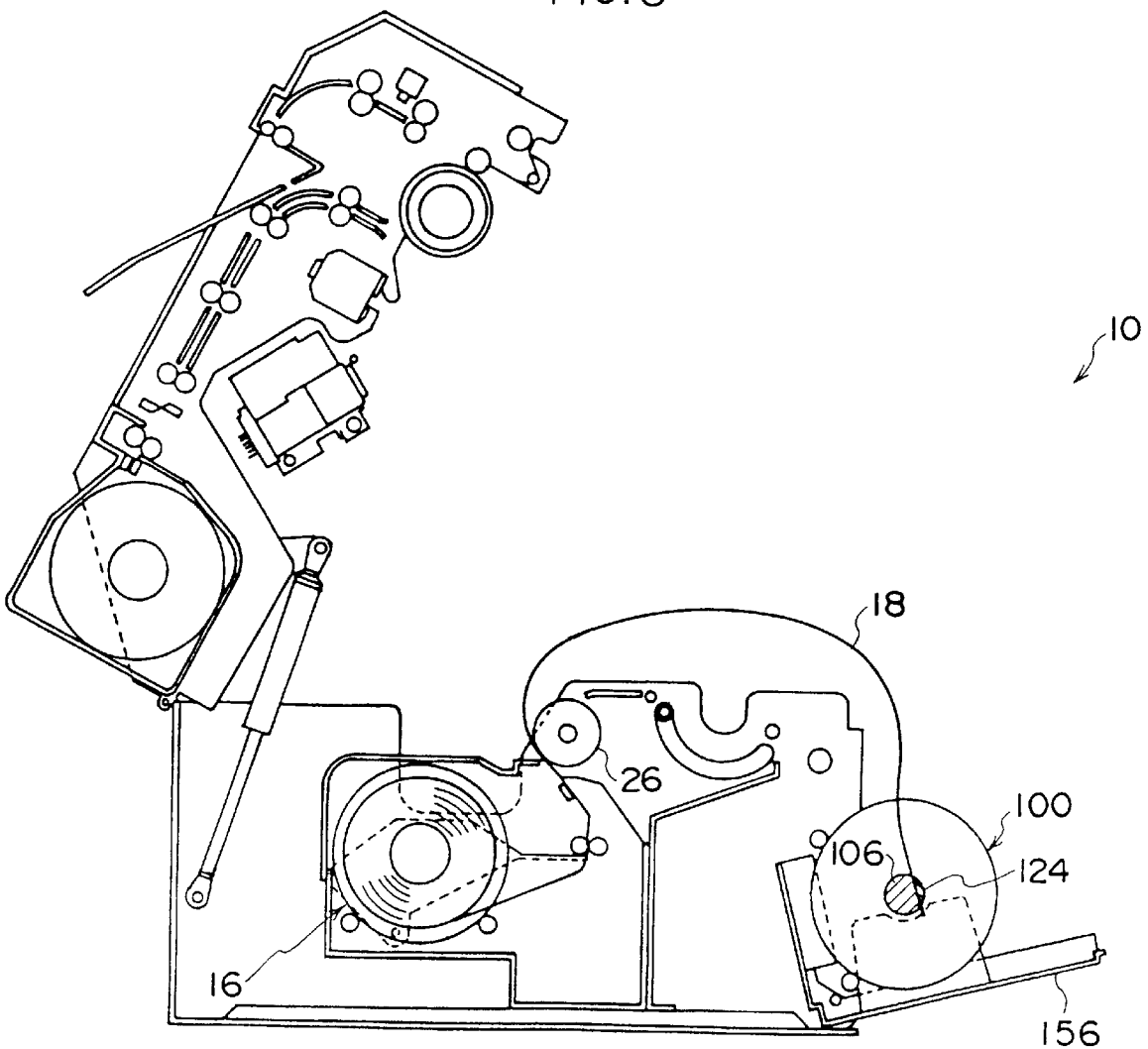
FIG. 8 is a side view showing the entire structure of the image forming apparatus according to the present embodiment, and an operating procedure thereof.

Next, as shown in FIG. 8, the photosensitive material 18 is wound at the platen roll 26, and the leading end portion of the photosensitive material 18 is fastened between the core 106 and the holding member 124 of the disposal reel 100.

Figure 9:
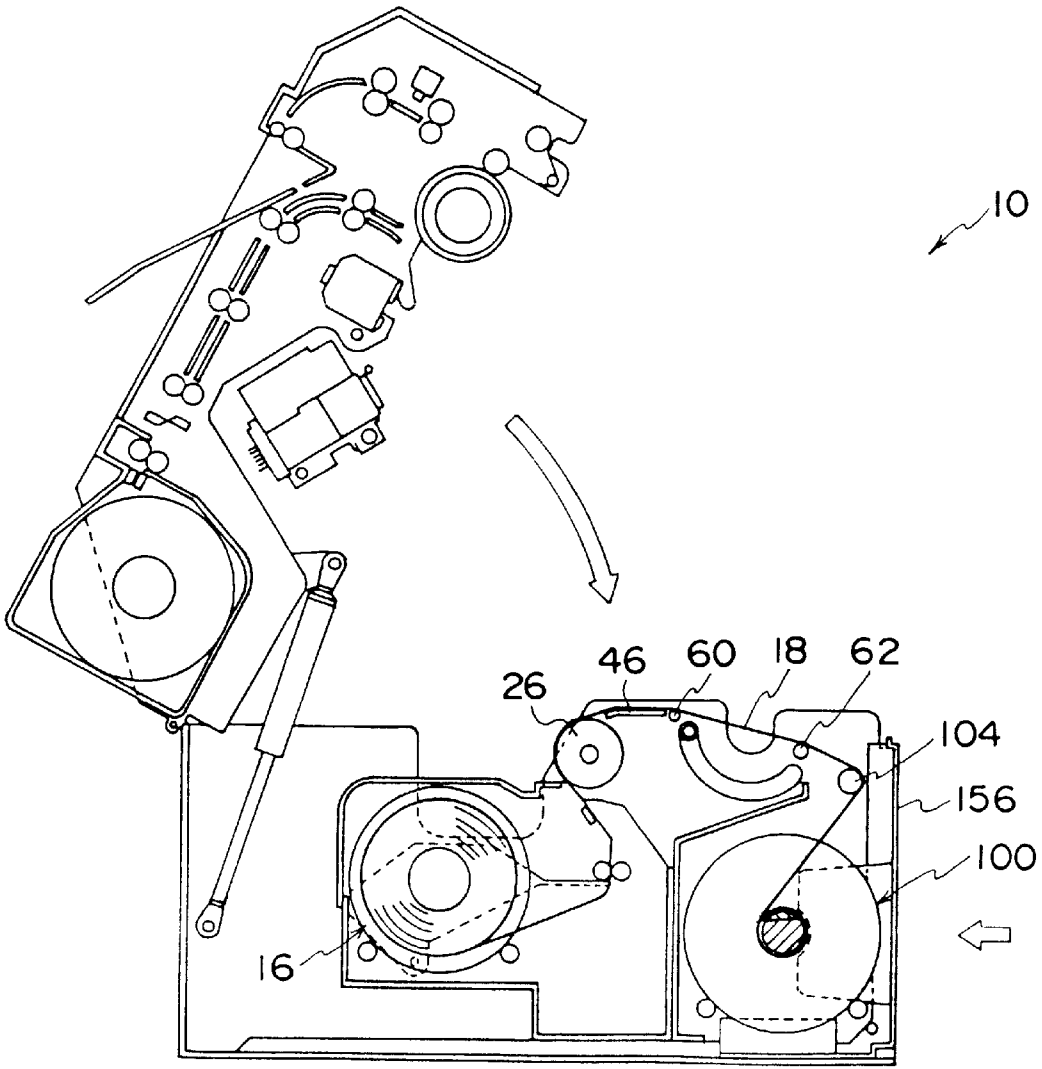
FIG. 9 is a side view showing the entire structure of the image forming apparatus according to the present embodiment, and an operating procedure thereof.

Thereafter, as shown in FIG. 9, the disposal magazine 156 is closed, and the photosensitive material 18 is taken up a predetermined amount by the disposal reel 100. As a result, the photosensitive material 18 is made to hang across the platen roll 26, the surface heater 46, the turn roller 60, the stripping turn roller 62, and the nip roller 104.

Figure 2:
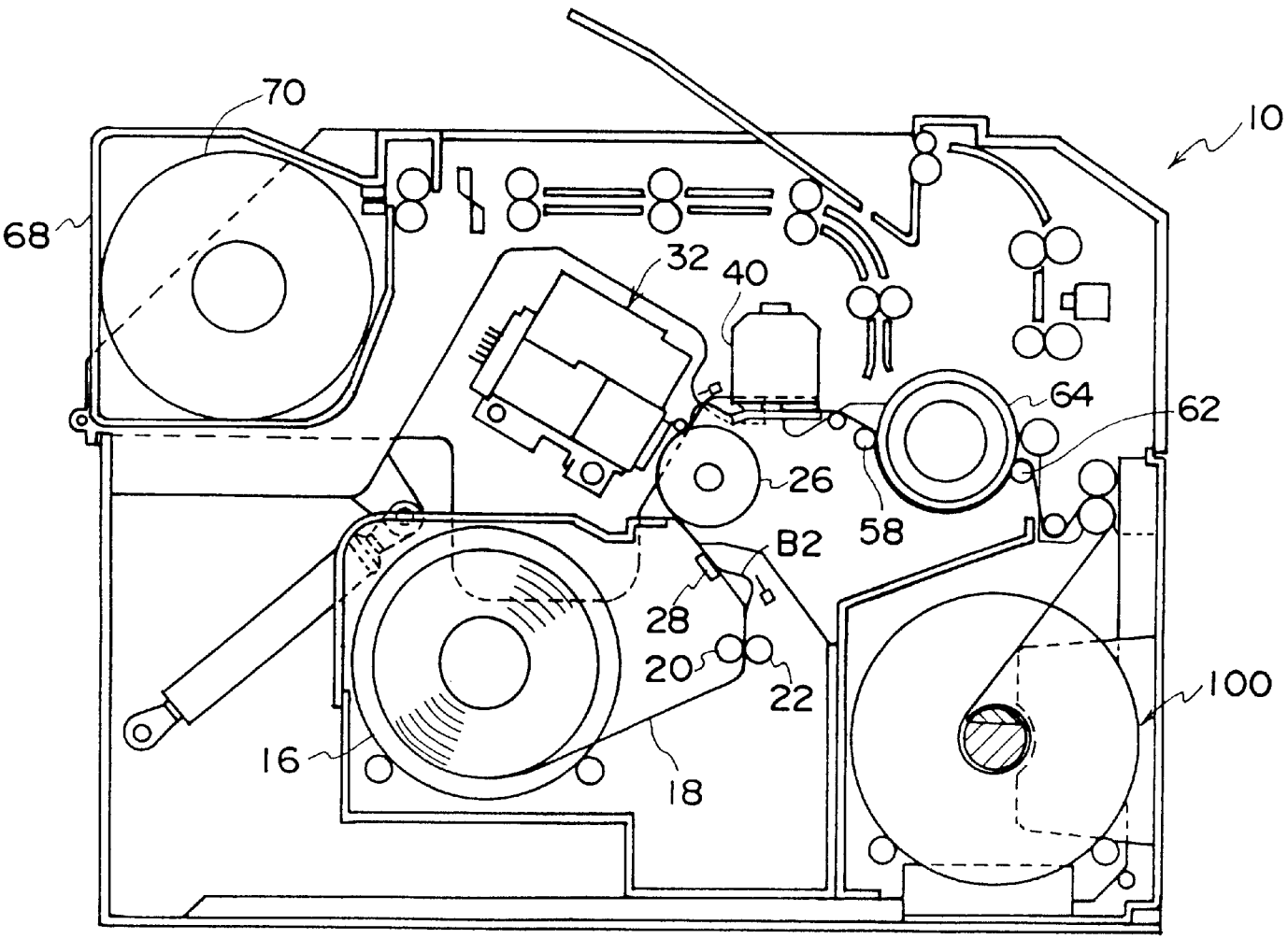
FIG. 2 is a side view showing the entire structure of the image forming apparatus according to the present embodiment, and an operating procedure thereof.

Thereafter, as shown in FIGS. 1 and 2, when the upper body section 10A is closed, the photosensitive material 18 is interposed between the nip roller 38 and the platen roll 26, and is wound at a portion of the heating drum 64. After a buffer is formed, image formation becomes possible.

In the present embodiment, the supply reel was directly replaced. However, a photosensitive material roll may be removed from its outer packaging material and placed into the magazine. Thereafter, the cover is locked, the photosensitive material is pulled out until the leading end portion emerges, and the magazine is loaded into the image forming apparatus.

What is claimed is:

1. An image forming apparatus, comprising:

(a) a rotatably mounted heating drum;

(b) an image-receiving material supplying device that feeds an image-receiving material which is in a form of a roll, and winds the image-receiving material at the heating drum;

(c) a photosensitive material supplying device that feeds a photosensitive material which is in a form of a roll, conveying the photosensitive material to an exposure section;

(d) an application device that applies a solvent to the photosensitive material that has been exposed at the exposure section;

(e) a laminating device that laminates the photosensitive material after the solvent has been applied thereto, with the image-receiving material, on the heating drum; and (f) a take-up device taking up the used photosensitive material laminated with the image-receiving material, wherein said laminating device includes at least one laminating roller rotatable around the heating drum, with the photosensitive material and the image-receiving material disposed between the at least one laminating roller and the heating drum, said laminating roller being in physical contact with said photosensitive material.

2. An image forming apparatus according to claim 1, wherein the laminating device further comprises:

a stripping device that strips a trailing-end of the photosensitive material from the heating drum, in conjunction with the rotation of one laminating roller of the at least one laminating roller, which is provided at a downstream side in the direction in which the photosensitive material and the image-receiving material are conveyed.

3. An image forming apparatus according to claim 2, wherein the take-up device comprises:

(a) a core;

(b) a holding member swingably attached to the core, for holding an end portion of the photosensitive material against the core;

(c) an engaging pawl protruding from the core for penetrating the photosensitive material and passing therethrough;

(d) a flange provided at two ends of the core, at least one of the flanges being detachable; and (e) a releasing device for collapsing the engaging pawl when the photosensitive material has been wound around the core, and is to be pulled therefrom in an axial direction of the core.

4. An image forming apparatus according to claim 3, wherein the releasing device comprises:

(a) a pin spacially mounted in the interior of the core; and (b) a spring for urging the engaging pawl, the engaging pawl including a lower end portion having the spring fixed thereto.

5. An image forming apparatus according to claim 2, wherein the stripping device comprises a rotation arm, and a plurality of rollers.

6. An image forming apparatus according to claim 1, wherein the take-up device comprises:

(a) a core;

(b) a holding member swingably attached to the core, for holding an end portion of the photosensitive material against the core;

(c) an engaging pawl protruding from the core for penetrating the photosensitive material and passing therethrough;

(d) a flange provided at two ends of the core, at least one of the flanges being detachable; and (e) a releasing device for collapsing the engaging pawl when the photosensitive material has been wound around the core, and is to be pulled therefrom in an axial direction of the core.

7. An image forming apparatus according to claim 6, wherein the releasing device comprises:

(a) a pin spacially mounted in the interior of the core; and (b) a spring for urging the engaging pawl, the engaging pawl including a lower end portion having the spring fixed thereto.

8. An image forming apparatus according to claim 1, wherein the exposure section comprises:

(a) an imaging device having a light source and a plurality of lenses; and (b) a scanning head, the scanning head being synchronized with step-wise rotation of a platen roll and carrying out transverse scan-exposure of the photosensitive material, which is wound at the platen roll and is step-driven.

9. An image forming apparatus according to claim 1, wherein the image forming apparatus includes an upper body supporting the image-receiving material supplying device, the application device, a portion of the laminating device, the exposure section, and the heating drum, and a lower body supporting the photosensitive material supplying device and the take-up device, the upper body being attached to the lower body by a hinge member axially supporting the upper body such that opening and closing is possible and by an energizing member that pushes up the upper body to release it from the lower body.

10. An image forming apparatus according to claim 1, further comprising a cutting device provided between the image-receiving material supplying device and the heating drum, for cutting the image-receiving material to a desired size.

11. The image forming apparatus according to claim 1 further comprising a rotatable tension arm disposed adjacent to said application device, wherein the photosensitive material operably travels over said tension arm, and said tension arm braces the photosensitive material against a portion of the application device during a recording period of the image forming apparatus.

12. The image forming apparatus according to claim 11, further comprising a photodetector disposed in a rotational path of said tension arm to control conveyance of the photosensitive material.

13. An image forming apparatus, comprising (a) a rotatably mounted heating drum;

(b) an image-receiving material supplying device that feeds an image-receiving material which is in a form of a roll, and winds the image-receiving material at the heating drum;

(c) a photosensitive material supplying device that feeds a photosensitive material which is in a form of a roll, conveying the photosensitive material to an exposure section;

(d) an application device that applies a solvent to the photosensitive material that has been exposed at the exposure section;

(e) a laminating device that laminates the photosensitive material after the solvent has been applied thereto, with the image-receiving material, on the heating drum; and (f) a take-up device taking up the used photosensitive material laminated with the image-receiving material;

wherein the laminating device further comprises:

at least one laminating roller rotatable around the heating drum, with the photosensitive material and the image-receiving material disposed between the at least one laminating roller and the heating drum;

a stripping device that strips a trailing-end of the photosensitive material from the heating drum, in conjunction with the rotation of one laminating roller of the at least one laminating roller which is provided at a downstream side in the direction in which the photosensitive material and the image-receiving material are conveyed; and wherein the application device comprises:

(a) a swinging device having an application unit supported therefrom, the application unit including an application portion for a solvent and being swingable; and (b) a driving device for causing the application portion to contact the photosensitive material at an angle such that an entire surface of the application portion is gradually brought into contact with the photosensitive material.

14. An image forming apparatus according to claim 13, wherein the take-up device comprises:

(a) a core;

(b) a holding member swingably attached to the core, for holding an end portion of the photosensitive material against the core;

(c) an engaging pawl protruding from the core for penetrating the photosensitive material and passing therethrough;

(d) a flange provided at two ends of the core, at least one of the flanges being detachable; and (e) a releasing device for collapsing the engaging pawl when the photosensitive material has been wound around the core, and is to be pulled therefrom in an axial direction of the core.

15. An image forming apparatus according to claim 14, wherein the core includes an interior and the releasing device comprises:

(a) a pin spacially mounted in the interior of the core; and (b) a spring for urging the engaging pawl, the engaging pawl including a lower end portion having the spring fixed thereto.

16. An image forming apparatus according to claim 13, further comprising a buffer-forming device that forms a buffer in the photosensitive material between the application device and the exposure section.

17. An image forming apparatus according to claim 16, further comprising a buffer detecting device that detects the buffer formed in the photosensitive material.

18. The image forming apparatus according to claim 13 further comprising a rotatable tension arm disposed to adjacent to said application device, wherein the photosensitive material operably travels over said tension arm, and said tension arm braces the photosensitive material against a portion of the application device during a recording period of the image forming apparatus.

19. An image forming apparatus comprising (a) a rotatably mounted heating drum;

(b) an image-receiving material supplying device that feeds an image-receiving material which is in a form of a roll, and winds the image-receiving material at the heating drum;

(c) a photosensitive material supplying device that feeds a photosensitive material which is in a form of a roll, conveying the photosensitive material to an exposure section;

(d) an application device that applies a solvent to the photosensitive material that has been exposed at the exposure section;

(e) a laminating device that laminates the photosensitive material after the solvent has been applied thereto, with the image-receiving material, on the heating drum; and (f) a take-up device taking up the used photosensitive material laminated with the image-receiving material;

wherein the application device comprises:

(a) a swinging device having an application unit supported therefrom, the application unit including an application portion for a solvent and being swingable; and (b) a driving device for causing the application portion to contact the photosensitive material at an angle such that an entire surface of the application portion is gradually brought into contact with the photosensitive material.

20. An image forming apparatus according to claim 19, wherein the take-up device comprises:

(a) a core;

(b) a holding member swingably attached to the core, for holding an end portion of the photosensitive material against the core;

(c) an engaging pawl protruding from the core for penetrating the photosensitive material and passing therethrough;

(d) a flange provided at two ends of the core, at least one of the flanges being detachable; and (e) a releasing device for collapsing the engaging pawl when the photosensitive material has been wound around the core, and is to be pulled therefrom in an axial direction of the core.

21. An image forming apparatus according to claim 20, wherein the releasing device comprises:

(a) a pin spacially mounted in the interior of the core; and (b) a spring for urging the engaging pawl, the engaging pawl including a lower end portion having the spring fixed thereto.

22. An image forming apparatus according to claim 19, further comprising a buffer-forming device that forms a buffer in the photosensitive material between the application device and the exposure section.

23. An image forming apparatus according to claim 22, further comprising a buffer detecting device that detects the buffer formed in the photosensitive material.

24. The image forming apparatus according to claim 19 further comprising a rotatable tension arm disposed adjacent to said application device, wherein the photosensitive material operably travels over said tension arm, and said tension arm braces the photosensitive material against a portion of the application device during a recording period of the image forming apparatus.

* * * * *